US005551384A

United States Patent [19]

Hollis

[11] Patent Number: 5,551,384

[45] Date of Patent: Sep. 3, 1996

[54] SYSTEM FOR HEATING TEMPERATURE CONTROL FLUID USING THE ENGINE EXHAUST MANIFOLD

[76] Inventor: Thomas J. Hollis, 5 Roxbury Dr., Medford, N.J. 08055

[21] Appl. No.: 447,468

[22] Filed: May 23, 1995

[51] Int. Cl.[6] ..... F02N 17/02

[52] U.S. Cl. ..... 123/142.5 R; 123/196 AB; 165/52; 237/12.3 B

[58] Field of Search ..... 123/142.5 R, 196 AB, 123/41.05, 41.08, 41.22, 41.33; 165/52, 43; 237/12.3 B

[56] References Cited

U.S. PATENT DOCUMENTS

| | | | |
|---|---|---|---|
| 1,168,623 | 1/1916 | Furber . | |
| 1,719,321 | 2/1929 | De long . | |
| 1,873,379 | 8/1932 | Frentzel, Jr. . | |
| 1,937,514 | 12/1933 | Foutz . | |
| 2,021,569 | 11/1935 | Pasco . | |
| 2,121,090 | 6/1938 | Kuehn . | |
| 2,180,663 | 11/1939 | Bergeron et al. . | |
| 2,354,345 | 7/1944 | Wintergreen . | |
| 2,400,977 | 5/1946 | Clarkson . | |
| 2,495,401 | 1/1950 | Worthington . | |
| 2,581,747 | 1/1952 | Block . | |
| 2,748,570 | 6/1956 | Booth . | |
| 3,134,374 | 5/1964 | Stevens . | |
| 3,357,413 | 12/1967 | Quinton | 123/41.05 |
| 3,397,684 | 8/1968 | Scherenberg . | |
| 3,450,109 | 6/1969 | Gratzmuller . | |
| 3,526,214 | 9/1970 | Kamo . | |
| 3,732,696 | 5/1973 | Masaki . | |
| 4,079,715 | 3/1978 | Masaki et al. . | |
| 4,095,575 | 6/1978 | Wulf | 123/142.5 R |
| 4,249,491 | 2/1981 | Stein . | |
| 4,258,676 | 3/1981 | Lamm | 123/142.5 R |
| 4,258,677 | 3/1981 | Sanders . | |
| 4,348,991 | 9/1982 | Stang et al. . | |
| 4,391,235 | 7/1983 | Majkrzak | 123/142.5 R |
| 4,448,157 | 5/1984 | Eckstein et al. . | |
| 4,537,349 | 8/1985 | Stolz | 123/142.5 R |
| 4,541,368 | 9/1985 | Castarede . | |
| 4,682,649 | 7/1987 | Greer . | |
| 4,685,430 | 8/1987 | Ap | 123/142.5 R |
| 4,756,359 | 7/1988 | Greer . | |
| 4,805,403 | 2/1989 | Bowman et al. . | |
| 4,911,110 | 3/1990 | Isoda et al. . | |
| 4,991,546 | 2/1991 | Yoshimura . | |
| 5,121,714 | 6/1992 | Susa et al. | 123/41.29 |
| 5,170,755 | 12/1992 | Kano et al. . | |
| 5,215,044 | 6/1993 | Banzhaf et al. . | |
| 5,415,147 | 5/1995 | Nagle et al. . | |

FOREIGN PATENT DOCUMENTS

| | | | |
|---|---|---|---|
| 3435833 | 4/1986 | Germany . | |
| 3516502 | 11/1986 | Germany . | |
| 4033261 | 6/1992 | Germany . | |
| 3164516 | 7/1991 | Japan | 123/142.5 R |

*Primary Examiner*—Erick R. Solis

*Attorney, Agent, or Firm*—Seidel, Gonda, Lavorgna & Monaco

[57] ABSTRACT

A temperature control system in an internal combustion engine includes a heating arrangement which channels a flow of temperature control fluid from an engine to and from an exhaust heating assembly which is located adjacent to an exhaust manifold in the engine. The exhaust heat assembly permits the transfer of heat from the exhaust gases flowing in the exhaust manifold to the temperature control fluid. The heated temperature control fluid is then directed back to the engine for efficient heating. In one embodiment, the temperature control fluid is directed through a heat exchanger in the engine oil pan so as to maintain the temperature of the engine lubricating oil at or near its optimum operating temperature. In a second embodiment, the temperature control fluid is directed from the exhaust heat assembly to the intake manifold so as to increase the temperature of the intake air prior to combustion.

17 Claims, 19 Drawing Sheets

22
12
30
400
200
216
212
214
116B
ECU
900
210
132
122
112
68
56
16
72
54
18
44
131
60

SYSTEM FOR HEATING TEMPERATURE CONTROL FLUID USING THE ENGINE EXHAUST MANIFOLD

CROSS REFERENCE TO RELATED APPLICATION

This application is related to U.S. application Ser. No. 08/390,711, filed Feb. 17, 1995, now abandoned and entitled "SYSTEM FOR MAINTAINING ENGINE OIL AT AN OPTIMUM TEMPERATURE," which is a continuation-in-part of U.S. application Ser. No. 08/306,272 filed Sep. 14, 1994, now U.S. Pat. No. 5,467,745, and entitled "SYSTEM FOR DETERMINING THE APPROPRIATE STATE OF A FLOW CONTROL VALVE AND CONTROLLING ITS STATE." The entire disclosures of both of these applications is incorporated herein by reference. This application is also related to U.S. application Ser. No. 08/306,240, filed Sep. 14, 1994, now U.S. Pat. No. 5,458,096, and entitled "HYDRAULICALLY OPERATED ELECTRONIC ENGINE TEMPERATURE CONTROL VALVE," and to U.S. application Ser. No. 08/306,281, filed Sep. 14, 1994, now U.S. Pat. No. 5,463,986 and entitled "HYDRAULICALLY OPERATED RESTRICTOR/SHUTOFF FLOW CONTROL VALVE." The entire disclosures of both of these applications is also incorporated herein by reference.

FIELD OF THE INVENTION

This invention relates to a system for heating and cooling an internal combustion gasoline or diesel engine by controlling the flow of temperature control fluid to and from an exhaust heat assembly positioned adjacent to an exhaust manifold.

BACKGROUND OF THE INVENTION

Page 169 of the *Goodheart-Willcox automotive encyclopedia*, The Goodheart-Willcox Company, Inc., South Holland, Ill., 1995 describes that as fuel is burned in an internal combustion engine, about one-third of the heat energy in the fuel is converted to power. Another third goes out the exhaust pipe unused, and the remaining third must be handled by a cooling system. This third is often underestimated and even less understood.

Most internal combustion engines employ a pressurized cooling system to dissipate the heat energy generated by the combustion process. The cooling system circulates water or liquid coolant through a water jacket which surrounds certain parts of the engine (e.g., block, cylinder, cylinder head, pistons). The heat energy is transferred from the engine parts to the coolant in the water jacket. In hot ambient air temperature environments, or when the engine is working hard, the transferred heat energy will be so great that it will cause the liquid coolant to boil (i.e., vaporize) and destroy the cooling system. To prevent this from happening, the hot coolant is circulated through a radiator well before it reaches its boiling point. The radiator dissipates enough of the heat energy to the surrounding air to maintain the coolant in the liquid state.

In cold ambient air temperature environments, especially below zero degrees Fahrenheit, or when a cold engine is started, the coolant rarely becomes hot enough to boil. Thus, the coolant does not need to flow through the radiator. Nor is it desirable to dissipate the heat energy in the coolant in such environments since internal combustion engines operate most efficiently and pollute the least when they are running relatively hot. A cold running engine will have significantly greater sliding friction between the pistons and respective cylinder walls than a hot running engine because oil viscosity decreases with temperature. A cold running engine will also have less complete combustion in the engine combustion chamber and will build up sludge more rapidly than a hot running engine. In an attempt to increase the combustion when the engine is cold, a richer fuel is provided. All of these factors lower fuel economy and increase levels of hydrocarbon exhaust emissions.

To avoid running the coolant through the radiator, coolant systems employ a thermostat. The thermostat operates as a one-way valve, blocking or allowing flow to the radiator. FIGS. 40–42 (described below) and FIG. 2 of U.S. Pat. No. 4,545,333 show typical prior art thermostat controlled coolant systems. Most prior art coolant systems employ wax pellet type or bimetallic coil type thermostats. These thermostats are self-contained devices which open and close according to precalibrated temperature values.

Coolant systems must perform a plurality of functions, in addition to cooling the engine parts. In cold weather, the cooling system must deliver hot coolant to heat exchangers associated with the heating and defrosting system so that the heater and defroster can deliver warm air to the passenger compartment and windows. The coolant system must also deliver hot coolant to the intake manifold to heat incoming air destined for combustion, especially in cold ambient air temperature environments, or when a cold engine is started. Ideally, the coolant system should also reduce its volume and speed of flow when the engine parts are cold so as to allow the engine to reach an optimum hot operating temperature. Since one or both of the intake manifold and heater need hot coolant in cold ambient air temperatures and/or during engine start-up, it is not practical to completely shut off the coolant flow through the engine block.

Practical design constraints limit the ability of the coolant system to adapt to a wide range of operating environments. For example, the heat removing capacity is limited by the size of the radiator and the volume and speed of coolant flow. The state of the self-contained prior art wax pellet type or bimetallic coil type thermostats is typically controlled only by coolant temperature.

Numerous proposals have been set forth in the prior art to more carefully tailor the coolant system to the needs of the vehicle and to improve upon the relatively inflexible prior art thermostats.

U.S. Pat. No. 4,484,541 discloses a vacuum operated diaphragm type flow control valve which replaces a prior art thermostat valve in an engine cooling system. When the coolant temperature is in a predetermined range, the state of the diaphragm valve is controlled in response to the intake manifold vacuum. This allows the engine coolant system to respond more closely to the actual load on the engine. U.S. Pat. No. 4,484,541 also discloses in FIG. 4 a system for blocking all coolant flow through a bypass passage when the diaphragm valve allows coolant flow into the radiator. In this manner, all of the coolant circulates through the radiator (i.e., none is diverted through the bypass passage), thereby shortening the cooling time.

U.S. Pat. No. 4,399,775 discloses a vacuum operated diaphragm valve for opening and closing a bypass for bypassing a wax pellet type thermostat valve. During light engine load operation, the diaphragm valve closes the bypass so that coolant flow to the radiator is controlled by the wax pellet type thermostat. During heavy engine load operation, the diaphragm valve opens the bypass, thereby removing the thermostat from the coolant flow path. Bypassing the thermostat increases the volume of cooling water flowing to the radiator, thereby increasing the thermal efficiency of the engine.

U.S. Pat. No. 4,399,776 discloses a solenoid actuated flow control valve for preventing coolant from circulating in the engine body in cold engine operation, thereby accelerating engine warm-up. This patent also employs a conventional thermostat valve.

U.S. Pat. No. 4,545,333 discloses a vacuum actuated diaphragm flow control valve for replacing a conventional thermostat valve. The flow control valve is computer controlled according to sensed engine parameters.

U.S. Pat. No. 4,369,738 discloses a radiator flow regulation valve and a block transfer flow regulation valve which replace the function of the prior art thermostat valve. Both of those valves receive electrical control signals from a controller. The valves may be either vacuum actuated diaphragm valves or may be directly actuated by linear motors, solenoids or the like. In one embodiment of the invention disclosed in this patent, the controller varies the opening amount of the radiator flow regulation valve in accordance with a block output fluid temperature.

U.S. Pat. No. 5,121,714 discloses a system for directing coolant into the engine in two different streams when the oil temperature is above a predetermined value. One stream flows through the cylinder head and the other stream flows through the cylinder block. When the oil temperature is below the predetermined value, a flow control valve closes off the stream through the cylinder block. Although this patent suggests that the flow control valve can be hydraulically actuated, no specific examples are disclosed. The flow control valve is connected to an electronic control unit (ECU). This patent describes that the ECU receives signals from an outside air temperature sensor, an intake air temperature sensor, an intake pipe vacuum pressure sensor, a vehicle velocity sensor, an engine rotation sensor and an oil temperature sensor. The ECU calculates the best operating conditions of the engine cooling system and sends control signals to the flow control valve and to other engine cooling system components.

U.S. Pat. No. 5,121,714 employs a typical prior art thermostat valve 108 for directing the cooling fluid through a radiator when its temperature is above a preselected value. This patent also describes that the thermostat valve can be replaced by an electrical-control valve, although no specific examples are disclosed.

U.S. Pat. No. 4,744,336 discloses a solenoid actuated piston type flow control valve for infinitely varying coolant flow into a servo controlled valve. The solenoids receive pulse signals from an electronic control unit (ECU). The ECU receives inputs from sensors measuring ambient temperature, engine input and output coolant temperature, combustion temperature, manifold pressure and heater temperature.

One prior art method for tailoring the cooling needs of an engine to the actual engine operating conditions is to selectively cool different portions of an engine block by directing coolant through different cooling jackets (i.e., multiple circuit cooling systems). Typically, one cooling jacket is associated with the engine cylinder head and another cooling jacket is associated with the cylinder block.

For example, U.S. Pat. No. 4,539,942 employs a single cooling fluid pump and a plurality of flow control valves to selectively direct the coolant through the respective portions of the engine block. U.S. Pat. No. 4,423,705 shows in FIGS. 4 and 5 a system which employs a single water pump and a flow divider valve for directing cooling water to head and block portions of the engine.

Other prior art systems employ two separate water pumps, one for each jacket. Examples of these systems are given in U.S. Pat. No. 4,423,705 (see FIG. 1), U.S. Pat. No. 4,726,324, U.S. Pat. No. 4,726,325 and U.S. Pat. No. 4,369,738.

Still other prior art systems employ a single water pump and single water jacket, and vary the flow rate of the coolant by varying the speed of the water pump.

U.S. Pat. No. 5,121,714 discloses a water pump which is driven by an oil hydraulic motor. The oil hydraulic motor is connected to an oil hydraulic pump which is driven by the engine through a clutch. An electronic control unit (ECU) varies the discharge volume of the water pump according to selected engine parameters.

U.S. Pat. No. 4,079,715 discloses an electromagnetic clutch for disengaging a water pump from its drive means during engine start-up or when the engine coolant temperature is below a predetermined level.

Published application nos. JP 55-35167 and JP 53-136144 (described in column 1, lines 30–62 of U.S. Pat. No. 4,423,705) disclose clutches associated with the driving mechanism of a water pump so that the pump can be stopped under cold engine operation or when the cooling water temperature is below a predetermined value.

The goal of all engine cooling systems is to maintain the internal engine temperature as close as possible to a predetermined optimum value. Since engine coolant temperature generally tracks internal engine temperature, the prior art approach to controlling internal engine temperature control is to control engine coolant temperature. Many problems arise from this approach. For example, sudden load increases on an engine may cause the internal engine temperature to significantly exceed the optimum value before the coolant temperature reflects this fact. If the thermostat is in the closed state just before the sudden load increase, the extra delay in opening will prolong the period of time in which the engine is unnecessarily overheated.

Another problem occurs during engine start-up or warm-up. During this period of time, the coolant temperature rises more rapidly than the internal engine temperature. Since the thermostat is actuated by coolant temperature, it often opens before the internal engine temperature has reached its optimum value, thereby causing coolant in the water jacket to prematurely cool the engine. Still other scenarios exist where the engine coolant temperature cannot be sufficiently regulated to cause the desired internal engine temperature.

When the internal engine temperature is not maintained at an optimum value, the engine oil will also not be at the optimum temperature. Engine oil life is largely dependent upon wear conditions. Engine oil life is significantly shortened if an engine is run either too cold or too hot. As noted above, a cold running engine will have less complete combustion in the engine combustion chamber and will build up sludge more rapidly than a hot running engine. The sludge contaminates the oil. A hot running engine will prematurely break down the oil. Thus, more frequent oil changes are needed when the internal engine temperature is not consistently maintained at its optimum value.

Prior an cooling systems also do not account for the fact that the optimum oil temperature varies with ambient air temperature. As the ambient air temperature declines, the internal engine components lose heat more rapidly to the environment and there is an increased cooling effect on the internal engine components from induction air. To counter these effects and thus maintain the internal engine components at the optimum operating temperature, the engine oil should be hotter in cold ambient air temperatures than in hot ambient air temperatures. Current prior art cooling systems cannot account for this difference because the cooling system is responsive only to coolant temperature.

Additionally, in order to control the flow of coolant between the cylinder head and the engine block, prior art cooling systems incorporated complicated valving arrangements which must be separately mounted to the engine and which occupy a significant amount of valuable engine compartment space. U.S. Pat. Nos. 4,539,942 and 5,121,714 illustrate typical cooling fluid control systems with complex valving arrangements.

Prior art cooling systems have also not taken full advantage of the heat generated during combustion of the air/fuel mixture. As discussed above, approximately one third of heat generated during the combustion of the fuel/air mixture is transferred through the exhaust system. Several prior art systems have attempted to utilize this heat for improving the efficiency of an engine. For example, U.S. Pat. No. 4,079,715 discloses a prior art method for using exhaust gases to heat the intake air. Special exhaust passageways are attached to the exhaust manifold and direct the exhaust gases through or adjacent to the intake manifold thereby permitting convection of the exhaust gas heat to the intake air.

A second prior art method for utilizing the heat in the exhaust gases is disclosed on pages 229 of the *Goodheart-Willcox automotive encyclopedia*, The Goodheart-Willcox Company, Inc., South Holland, Ill., 1995. This method requires the incorporation of a special duct or "crossover passage" around the exhaust manifold that traps the heat which is otherwise dissipated. This trapped heated air is then routed to the intake manifold where it preheats the intake air.

These prior art methods all require the addition of special, relatively heavy ducting which must be designed to be thermally compatible with the temperatures in the exhaust gases. Additionally, these systems have all been limited to heating the intake air. Hence, the prior art methods have not utilized the heat in the exhaust gases to assist in preheating the engine and/or the engine oil.

While many of the prior art systems address the problem of cooling an internal combustion engine, none have provided a workable, cost efficient system. Accordingly, a need therefore exists for a system which optimally controls the flow of a fluid in a cooling system and which requires minimal modifications to the current engine arrangement.

SUMMARY OF THE INVENTION

The present invention provides systems and methods for controlling the temperature of a liquid cooled internal combustion engine. The systems disclosed utilize a novel heating arrangement which controls the flow of temperature control fluid to and from an exhaust heat assembly located adjacent to an the engine exhaust manifold.

The system includes an exhaust manifold for exhausting heated gases which result from combustion of the air/fuel mixture in the engine. An exhaust input tube directs a flow of temperature control fluid from the engine cooling system and an exhaust output tube directs the flow of temperature control fluid back to the engine. An exhaust heat assembly is connected to the exhaust input and output tubes and channels the flow of temperature control fluid from the exhaust input tube to the exhaust output tube. The exhaust heat assembly is located adjacent or in close proximity to the exhaust manifold and is designed to permit heat transfer from the heated gases flowing in the exhaust manifold to the temperature control fluid in the exhaust heat assembly.

The exhaust heat assembly includes a heating conduit which is in contact or immediately adjacent to the manifold. First and second spacers are mounted on opposite ends of the heating conduit for preventing or minimizing the passage of heat from the heating conduit to the exhaust input and output tubes. In one embodiment, a ball check valve is positioned within the exhaust output tube to permit the flow of temperature control fluid to the engine and prevent the flow of temperature control fluid back into the exhaust heat assembly. Accordingly, only one way fluid flow is permitted along the exhaust output tube.

In one embodiment of the invention, the exhaust heat assembly receives a flow of temperature control fluid from a water pump in the engine. The water pump preferably has at least one flow restrictor valve located within the water pump which is adapted to control the flow of temperature control fluid flowing within the water pump. The flow restrictor valve is actuatable between a first position and a second position. The first position of the flow restrictor valve permits flow of temperature control fluid directly into the engine block. The second position of the flow restrictor valve restricts the flow into the engine block and, instead, directs a portion of flow of the temperature control fluid to the exhaust heat assembly.

In one operational mode of the invention, the novel exhaust heat assembly works in conjunction with a temperature control system for maintaining the temperature of the engine lubricating oil at or near its optimum operating temperature. For example, during engine warm-up or in cold environments when the temperature of the temperature control fluid is relatively cold, the flow restrictor valves in the water pump are in their second position which prevents or inhibits the flow of temperature control fluid through the engine block and, instead, directs a flow of temperature control fluid to the exhaust heat assembly along the exhaust input tube. The temperature control fluid is quickly heated by the heat flowing through the exhaust manifold and is recirculated back to the engine through the exhaust output tube.

In another embodiment of the invention, the heated temperature control fluid flowing through the exhaust output tube is directed into a heat exchanger positioned within the oil pan of the engine. This results in the transfer of heat from the temperature control fluid to the engine oil. Accordingly, the engine oil is heated as quickly as possible during engine warm-up.

In yet another embodiment of the invention, the heated temperature control fluid flowing through the exhaust output tube is directed into the intake manifold for heating the intake air prior to combustion. From the intake manifold, the heated temperature control fluid is preferably routed to the oil pan and the passenger compartment heater assembly.

After the engine has sufficiently warmed, the flow restrictor valves are actuated into their first position permitting flow of temperature fluid along the flow channels into the engine block. This stops the flow of temperature control fluid along the exhaust input tube.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, there is shown in the drawings a form which is presently preferred.

it being understood, however, that this invention is not limited to the precise arrangements and instrumentalities shown.

DESCRIPTION OF THE PREFERRED EMBODIMENTS

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Certain terminology is used herein for convenience only and is not be taken as a limitation on the invention. Particularly, words such as "upper," "lower," "left," "right," "horizontal," "vertical," "upward," and "downward" merely describe the configuration shown in the figures. Indeed, the valves and related components may be oriented in any direction. For example while a vertically oriented radiator is illustrated in the figures, a horizontally oriented radiator is well within the scope of the invention. The terms "inhibiting" and "restricting" are intended to cover both partial and full prevention of fluid flow.

Figure 1:
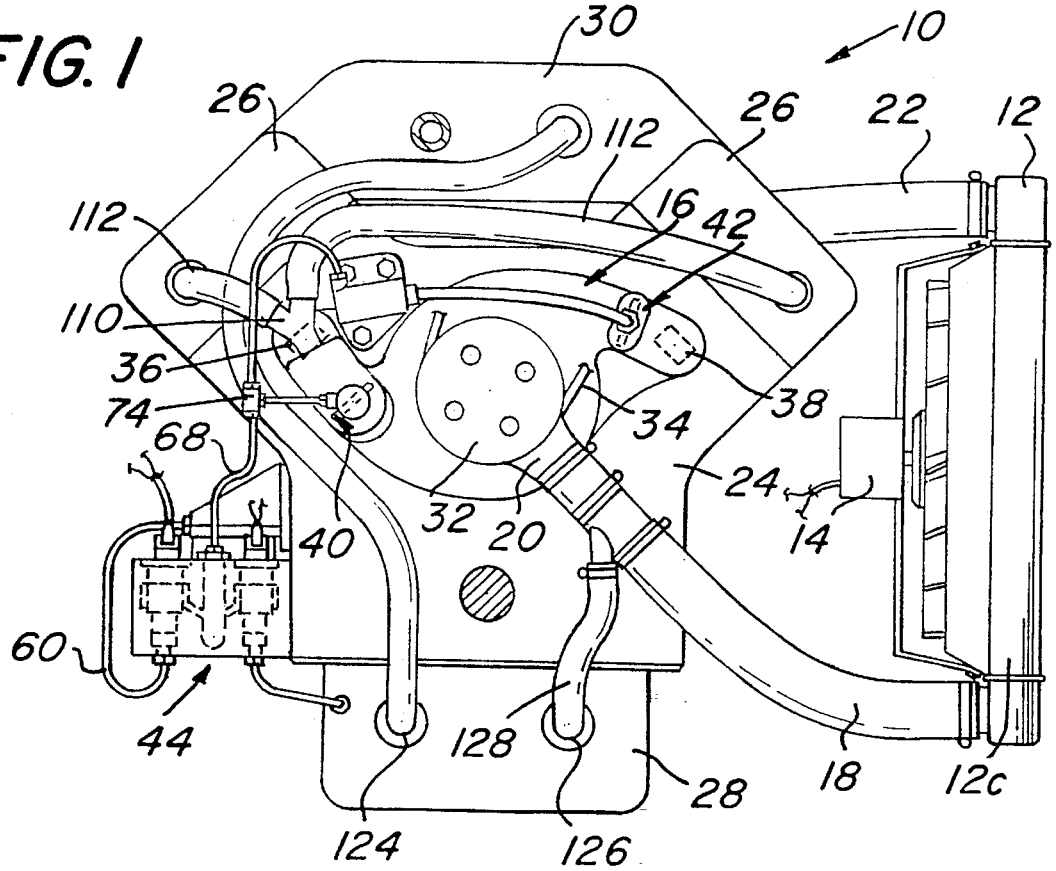
FIG. 1 is a side view of an internal combustion engine incorporating the novel water pump/engine block bypass system according to the present invention.

FIG. 1 illustrates an internal combustion engine generally designated with numeral 10. The internal combustion engine 10 depicted is a transverse mounted V-6 engine similar to a GM 3800 engine. The internal combustion engine includes a radiator 12 mounted in the forward facing portion of an engine compartment (not shown). Conventionally mounted to the aft of the radiator 12, between the radiator 12 and the engine 10, is a air circulation fan 14 adapted for drawing cool air through the radiator core 12C. A radiator outlet tube 18 is attached to the lower portion of radiator 12 and extends to and attaches with an inlet port 20 on a water pump 16. A radiator inlet tube 22 extends from the engine 10 and attaches to the upper portion of the radiator 12. The radiator inlet and outlet tubes 18, 22 direct temperature control fluid in to and out of the radiator 12 as will be discussed in more detail hereinbelow.

The internal combustion engine illustrated includes an engine block 24 and two cylinder heads 26 mounted to the upper portions of the engine block 24. Attached to the lower portion of the engine block 24 is an oil pan 28 which provides a reservoir for hydraulic engine lubricating oil. An oil pump (not shown) is located within the oil pan 28 and operates to direct hydraulic lubricating oil to the various members being driven within the engine. An intake manifold 30 is shown mounted between the cylinder heads 26 on the upper portion of the engine 10. The intake manifold directs a flow of air into the combustion chamber of the engine for mixing with the fuel.

The water pump 16 is attached to the engine block 24 and includes a rotatably mounted pulley 32. The pulley 32 is rotated by means of a belt 34 which, in turn, is driven by a drive mechanism (not shown). Rotation of the pulley 32 by the belt 34 produces corresponding rotation within the water pump 16. The water pump 16 has two primary modes of operation in the present invention. In the first mode of operation, the water pump functions in a similar fashion as a conventional water pump. The pulley 32 drives an internally mounted impeller (shown in FIG. 3) which directs the flow of temperature control fluid entering into the water pump 16 from its inlet port 20. The rotary motion of the impellers produces centrifugal forces on the temperature control fluid which cause the fluid to flow toward block inlet ports 36, 38 formed in the engine block 24. The block inlet ports 36, 38 are connected to the engine block water jacket (not shown) which surrounds the cylinders of the engine.

Upon entering the water jacket of the engine block 24 in the first mode of operation, the temperature control fluid flows through the engine block water jacket and then enters into the water jacket surrounding the cylinder heads 26. The effect of this temperature control fluid flow is the cooling of the engine block and cylinder heads through the removal of the heat generated during engine operation. This will be discussed below in more detail.

For the sake of brevity, when discussing the flow of temperature control fluid in the engine, it should be understood that the fluid flows through water jackets formed within the engine. For example, when discussing the flow of temperature control fluid through the engine block, it should be understood that the fluid is flowing through the water jacket of the engine block.

In the second mode of the water pump operation, the temperature control fluid circulating in the water pump 16 is not directed into the engine block 24 but, instead, is channeled directly into the cylinder heads 26. In order to do so, the water pump 16 has mounted thereto at least one hydraulically operated flow restrictor valve 40. The flow restrictor valve 40 is located so as to be capable of impeding the flow of the temperature control fluid from the impellers into the block inlet ports 36, 38. In the embodiment shown in FIG. 1, there are two flow restrictor valves 40, 42 mounted on the water pump 16. The first flow restrictor valve 40 prevents or restricts flow of temperature control fluid into the leftmost or aft block inlet port 36. The second flow restrictor valve 42 prevents or restricts flow of temperature control fluid into the rightmost or forward block inlet port 38.

The flow restrictor valves 40, 42 are actuatable between a first "open" position or state and a second "restricted" position or state. In the first or open position, the temperature control fluid is permitted to flow substantially unrestricted into the engine inlet ports 36, 38 (e.g., first mode of water pump 16 operation). In the second or restricted position the temperature control fluid is substantially inhibited from entering the engine block inlet ports 36, 38 (e.g., second mode of water pump 16 operation).

Figure 2:
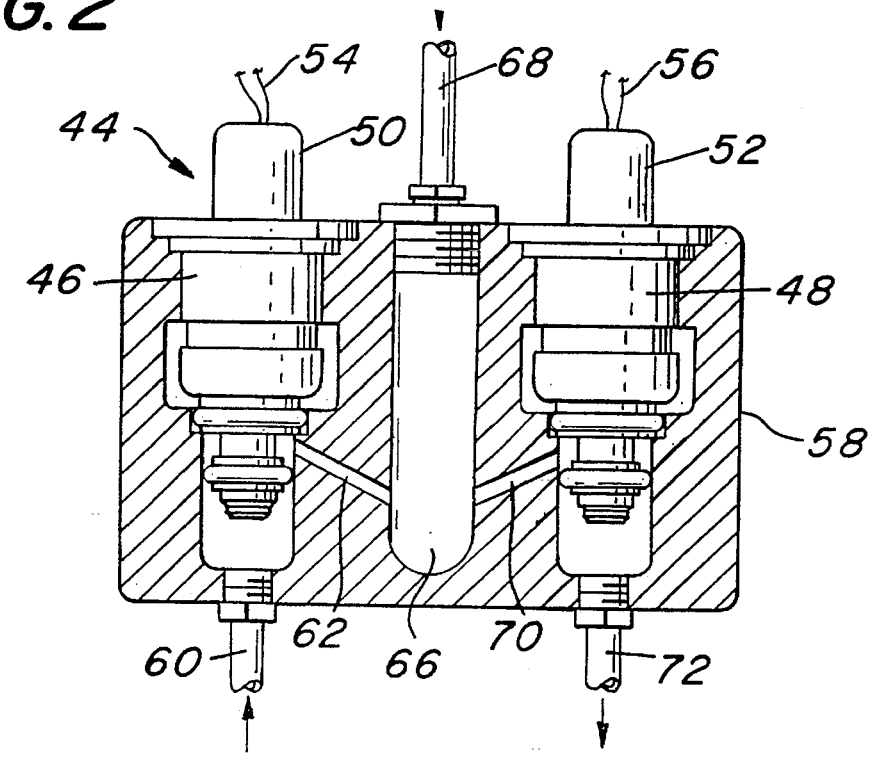
FIG. 2 is an enlarged view of the preferred hydraulic solenoid injector system for use with the novel water pump/engine bypass system.

The actuation of the flow restrictor valves 40, 42 is achieved by means of a hydraulic solenoid injector system (generally designated 44). The hydraulic injector system 44 controls the flow of a hydraulic fluid to and from the flow restrictor valves 40, 42 for actuating the valves between the first unrestricted position and the second restricted position. The preferred embodiment of the hydraulic solenoid injector system 44 is shown in more detail in FIG. 2 and includes input and output hydraulic fluid injectors 46, 48. Attached to the hydraulic fluid injectors 46, 48 are first and second solenoids 50, 52. The solenoids are designed to receive signals on control lines 54, 56 from an engine computer unit (ECU) for controlling the opening and closing of their respective hydraulic injectors 46, 48.

A source of pressurized hydraulic fluid (not shown) is connected to the housing 58 of the hydraulic solenoid injector system 44 through fluid inlet connector 60. In the preferred embodiment, the source of pressurized hydraulic fluid is engine lubrication oil flowing either directly from the oil pump or, more preferably, from an oil filter. The oil filter prevents debris from entering into the hydraulic injectors causing damage and/or malfunction. When the input hydraulic injector is open, a flow of pressurized hydraulic fluid enters into the fluid inlet connector 60, passes through the input hydraulic injector 46 and into passageway 62. This results in the filling of chamber 66 provided that the output hydraulic injector is closed. From the chamber 66, the hydraulic fluid is provided to the flow restrictor valves 40, 42 via supply line 68.

The output hydraulic injector 48 controls the emptying or depressurization of the chamber 66. The opening of the output hydraulic injector 48 causes the hydraulic fluid in chamber 66 to drain along passage 70 and through fluid outlet connector 72. A hydraulic fluid line from the fluid outlet connector 72 leads to a hydraulic fluid reservoir, such as the engine oil pan.

In the preferred embodiment, the hydraulic injectors are Siemens Deka II modified hydraulic fluid injectors. Details of these injectors are provided in the above-referenced related patent applications. Other injectors can be readily substituted therefor without departing from the scope of the invention.

Referring back to FIG. 1, in the illustrated embodiment, the hydraulic solenoid injector system 44 provides pressurized fluid for actuating both flow restrictor valves 40 and 42. The supply line 68 extends from the housing 58 and provides the flow of hydraulic fluid to the valves. The supply line 68 includes a tee member or splitter 74 which diverts part of the hydraulic fluid to each flow restrictor valve 40, 42. While a single hydraulic solenoid injector system 44 is utilized in the illustrated embodiment, it should be understood that separate hydraulic solenoid injector systems could be utilized to control each flow restrictor valve.

Figure 3:
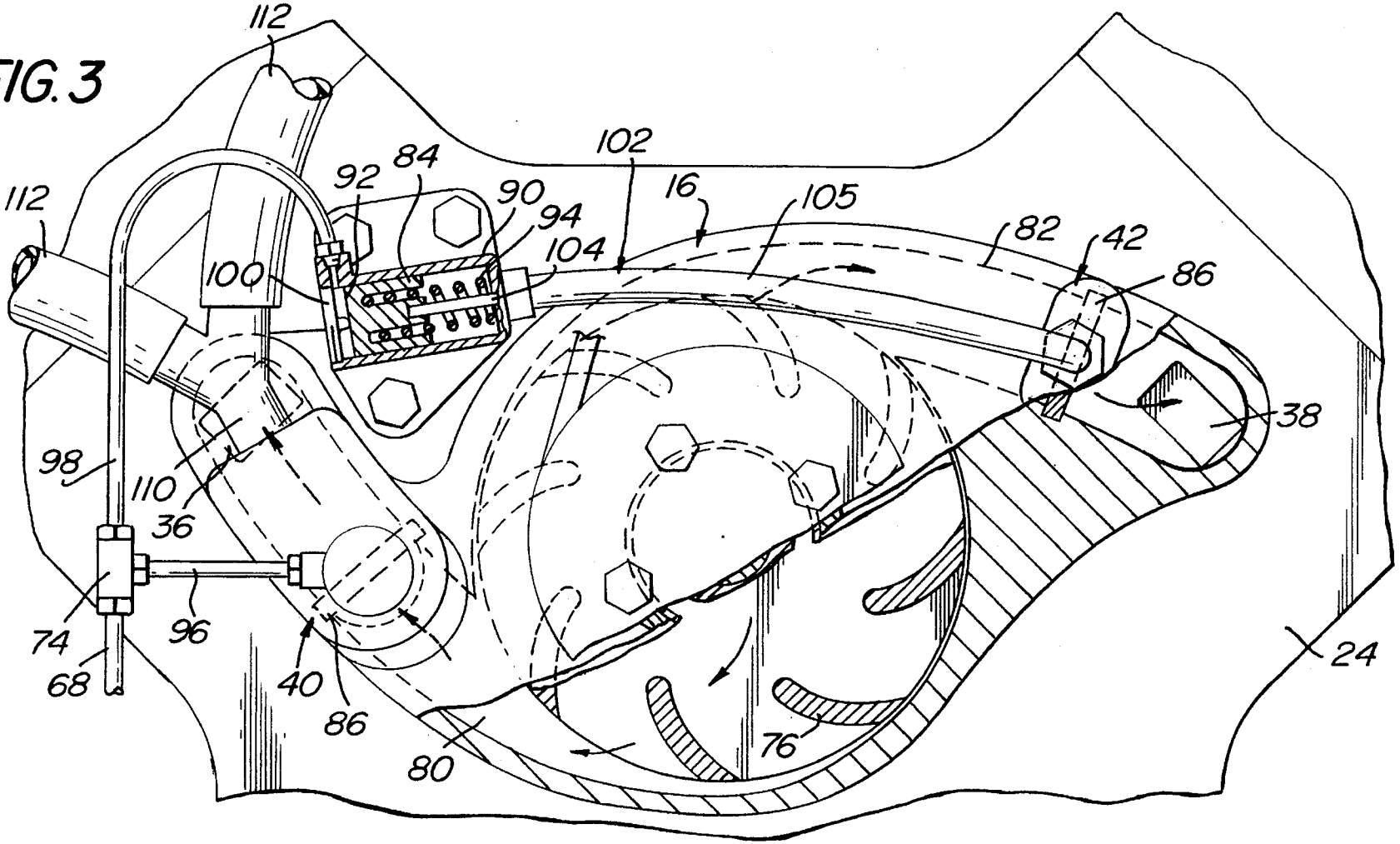
FIG. 3 is an enlarged partial section view of one embodiment of the novel water pump design illustrating the flow restrictor valves.

FIG. 3 is an enlargement of one embodiment of the novel water pump according to the present invention. As stated above an impeller 76 is rotatably mounted within the water pump 16 and directs the entering temperature control fluid in a circular pattern. This produces centrifugal forces on the temperature control fluid which cause the fluid to flow along first and second flow channels 80, 82. The flow channels 80, 82 extend from the impeller 76 to the block inlet ports 36, 38, respectively. Accordingly, when temperature control fluid flows from the radiator 12 into the water pump 16, it is driven in a circular fashion by the impeller 76 and directed down channels 80, 82 into block inlet ports 36, 38 leading into the engine block 24. The impeller 76 and flow channels 80, 82 are conventional in the art and do not need to be discussed further.

Also shown mounted to the water pump 16 in FIG. 3 are the flow restrictor valves 40, 42. As stated above, the flow restrictor valves 40, 42 are designed to prohibit or restrict flow of temperature control fluid along channels 80, 82 and into ports 36, 38. Each flow restrictor valve includes a piston 84 and a blade shut-off 86. The piston 84 is slidably disposed within a housing 90 and includes a pressure receiving surface 92 and a biasing spring 94. The actuation of the piston 84 translates the blade shutoff 86 between the first or open position and the second or restricted position. As discussed above, the open position of the flow restrictor valve permits flow of temperature control fluid along channels 80, 82 and into ports 36, 38, while the restricted position of the flow restrictor valve prevents flow or restricts flow along channels 80, 82.

The splitter 74 in the hydraulic fluid supply line 68 separates the hydraulic fluid flow along two lines 96, 98. Each line is directed to a separate flow restrictor valve 40, 42. When the input hydraulic injector is open, each line conveys hydraulic fluid into the housing of its respective flow restrictor valve. The hydraulic fluid fills a chamber 100 located between the housing 90 and the pressure receiving surface 92 of the piston 84. The filling of chamber 100 with pressurized fluid causes the pressure receiving surface 92 to compress the biasing spring 94.

Figure 4:
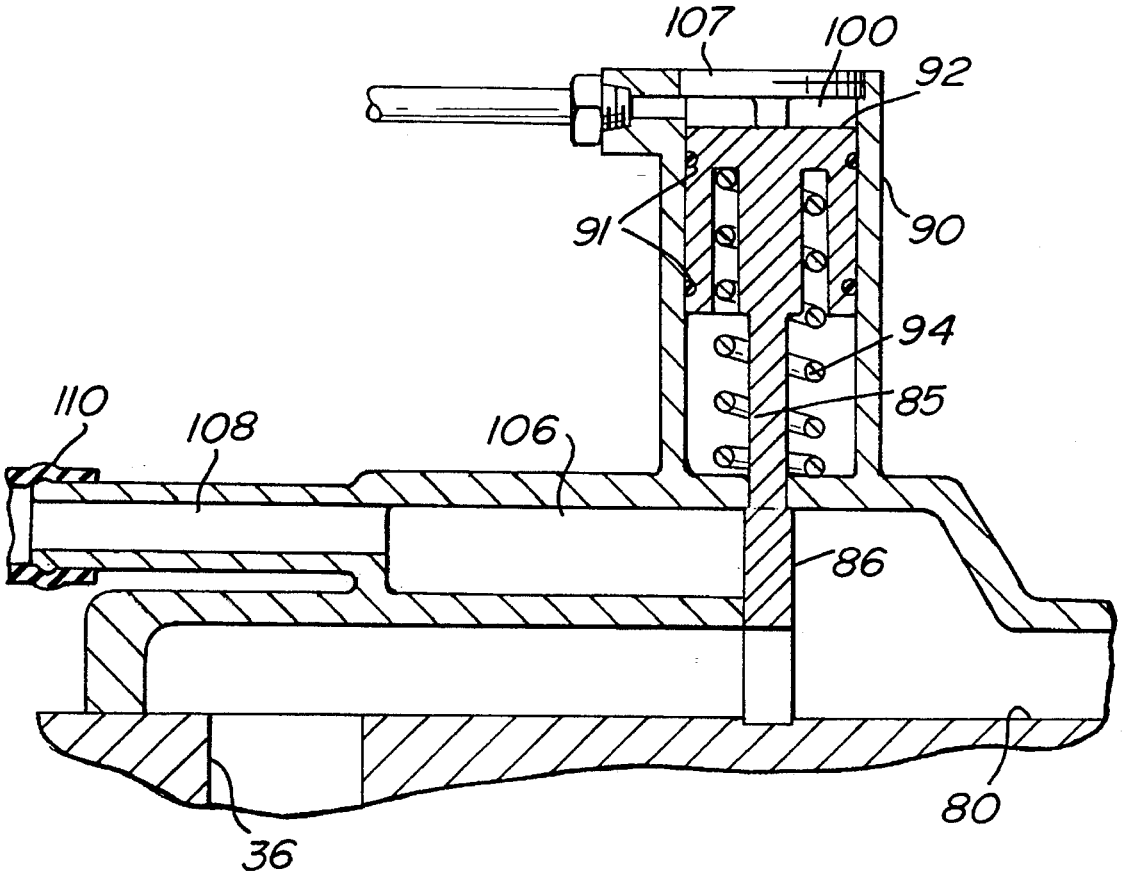
FIG. 4 is a section view of one embodiment of the flow restrictor valves according to the present invention.

The piston 84 is preferably mechanically connected to the blade shut-off 86 such that displacement of the piston 84 causes the blade shut-off 86 to translate between the first and second positions. In a preferred embodiment, the piston 84 is directly connected to the blade shut-off through an integral piston rod 85, such that translation of the piston 84 provides corresponding translation of the blade shut-off without need for intermediate mechanical connections. FIG. 4 illustrates this type of flow restrictor valve. As shown, the flow restrictor valve 40 is mounted directly onto the water pump 16 such that displacement of the piston 84 causes direct actuation of the blade shut-off.

While it is preferable to locate the blade shut-off 86 adjacent to the piston 84 so as to permit its direct actuation, the actual engine configuration may prohibit this. For example, in the GM 3800 V6 transverse mounted engine, the location of various engine components proximate to the water pump prevents mounting the pistons 84 of both flow restrictor valves directly in line with their respective blade shut-offs. Referring to the embodiment illustrated in FIG. 3, one flow restrictor valve 40 is configured so as to have the blade shut-off located directly in line with the piston. The second flow restricting valve, designated by the numeral 42, has its piston 84 located apart from the blade shut-off 86. A push-pull cable 102 is utilized to connect the piston 84 to the blade shut-off 86. The cable 102 has a push rod 104 slidably mounted within the cable sleeve 105. One end of the push rod 104 is attached to the piston 84. The opposite end of the push rod 104 is connected to the blade shut-off 86. Pressurization of the chamber 100 so as to produce translation of the piston 84 and compression of the biasing spring 94 causes the push rod 104 to slide within cable sleeve 105. This, in turn, causes the blade shut-off 86 to slide into the water pump 16, from its open position (permitting flow of temperature control fluid along flow channel 82) to its restricted position (prohibiting or restricting flow of temperature control fluid along flow channel 82).

In the preferred embodiment, the diameter of the piston 84 is between about 0.50 inches and about 2.0 inches. More preferably the diameter of the piston 84 is about 13/16 inches. One or more seals 91 are preferably positioned between the piston 84 and the housing 90 to prevent the leakage of hydraulic fluid. The preferred spring rate for the biasing spring 94 is approximately 5 lbf/in. Furthermore, approximately 15 psi hydraulic pressure is provided to actuate the piston 84.

It should be appreciated that alternate embodiments of the flow restrictor valves could be substituted into the water pump design without departing from the scope of this invention. For example, the piston 84 could be replaced by a diaphragm valve arrangement which provides translation of the push rod 104. Furthermore, it is also possible to eliminate the biasing spring and, instead, utilize the elastomeric properties of the diaphragm to provide the biasing needed. The hydraulic solenoid injection system could also be replaced by a pneumatic system which supplies a pressurized gas such as air. Still further modifications are possible such as utilizing linear actuators and/or other electromechanical devices to actuate the blade shut-off. Those skilled in the art, after having read the instant specification, would readily be capable of modifying the configurations shown without detracting from the operability of the invention.

FIG. 4 illustrates a sectional view of the flow restricting valve 40 showing some additional features of this particular valve. As stated above, the piston 84 is slidably disposed within the housing 90. The housing 90 has a cover 107 threadingly engaged with the housing for permitting access to the piston 84 and the biasing spring 94 for replacing and/or repairing these elements. The housing 90 of at least one of the flow restrictor valves (which, in the illustrated figure is the flow restrictor valve designated by the numeral 40) includes a bypass passageway 106 which is adjacent to the flow channel 80. The bypass passageway is attached to and in fluidic communication with the first flow channel 82 of the water pump 16. Hence, the bypass passageway 106 provides a second conduit along which the temperature control fluid can flow. The bypass passageway 106 has a bypass outlet 108 which connects with at least one bypass tube 110.

As illustrated, the blade shut-off 86 of the flow restrictor valve 40 is in the open position wherein the temperature control fluid is permitted to flow substantially unrestricted along first flow channel 80 and into the block inlet port 36. In this position, the blade shut-off 86 blocks or restricts the flow of temperature control fluid along the bypass passageway 106. When the flow restrictor valve 40 is actuated into its second or restricted position, the blade shut-off 86 is positioned within the first flow channel 80 preventing flow of temperature control fluid along flow channel 80 and into the block inlet port 36. In this position, the piston rod 85 is located at the entrance to the bypass passageway 106. The piston rod 85 is configured to permit the passage of temperature control fluid along the bypass passageway 106. In order to do so, the piston rod 85 is preferably formed either with a width that is dimensionally smaller than the width of the bypass passageway entrance, or has one or more apertures formed through it to permit the passage of temperature control fluid. In the preferred embodiment, the piston rod 85 has a cylindrical shape, the diameter of which is less than the width of the bypass passageway entrance. The diameter of the piston rod 85 is approximately 3/16ths of an inch. The opening to the bypass passageway is preferably about ½ inch high by 1 inch long. Accordingly, when the flow restrictor valve 40 is in its restricted position, the temperature control fluid is prevented or inhibited from passing directly into the engine block 24 through the block inlet port 36 and, instead, is permitted along the bypass passageway 106 and into the bypass tube 110.

Referring back to FIGS. 1 and 3, the bypass tube 110 connects with cylinder head input lines 112 for directing a flow of temperature control fluid along a bypass circuit to the cylinder heads 26. In a straight or inline engine, one cylinder head input line 112 would be utilized for channeling the temperature control fluid in the bypass circuit to the cylinder head. However, the illustrated embodiment is for a V6 engine which has separate cylinder heads. Accordingly, it is preferable that the bypass circuit include two cylinder head input lines 112 for channeling the temperature control fluid. As shown, the bypass tube 110 is split at a 'Y' joint separating the flow of temperature control fluid into the two cylinder head input lines 112. The two cylinder head input lines 112 are, preferably, balanced so as to provide substantially equal flow to the cylinder heads. Alternately, two bypass tubes 110 could be attached to the housing 90 for directing separate flows of the temperature control fluid. Accordingly, when the flow restrictor valve 40 is in its second or restricted position, the flow of temperature control fluid from the water pump 16 is channeled directly to the cylinder heads 26.

Figure 5:
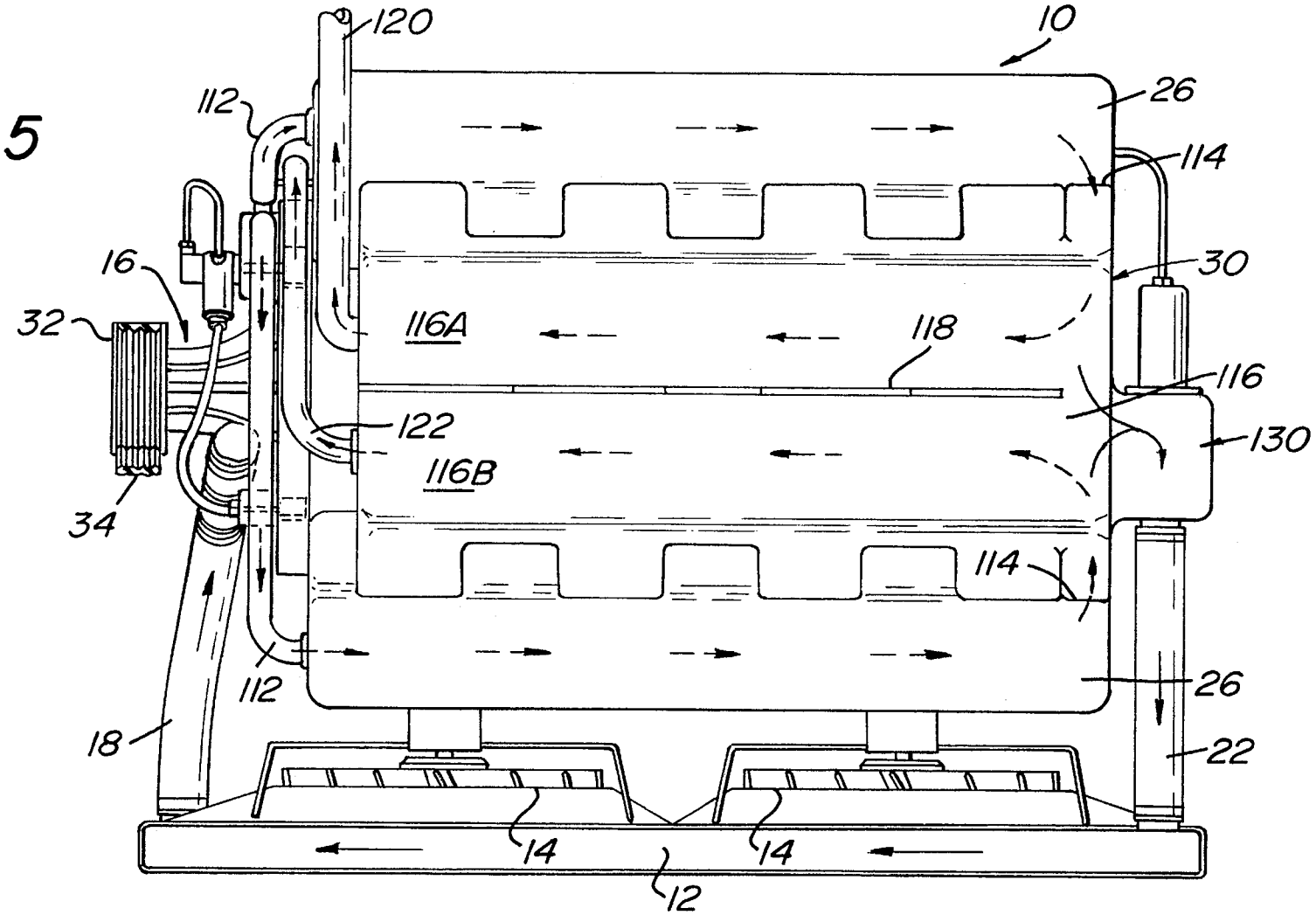
FIG. 5 is a diagrammatical plan view of the flow circuits of the temperature control fluid through the cylinder heads and the intake manifold according to the present invention.

In FIG. 5 a plan view of the engine is shown with the cylinder head input lines 112 attached to the cylinder heads 26. The flow of temperature control fluid is shown by the arrows in the figure. As can be seen, the flow of temperature control fluid enters the cylinder heads 26 at the attachment of the cylinder head input lines 112. The temperature control fluid flows across and around the cylinder heads to the aft portion of the cylinder head, which in the illustrated configuration is the rightmost portion of the engine. At this location, the temperature control fluid is directed along passageways 114 into the intake manifold 30.

The water jacket of intake manifold 30 is configured with two separate channels 116 separated by a wall 118. Both channels permit flow of temperature control fluid in the direction of the water pump as shown by the dashed arrows. One of the channels $\mathbf{116}_A$ in the intake manifold directs the flow of temperature control fluid to the heater assembly (not shown). More specifically, a heater tube 120 is attached to and in fluid communication with channel $116_A$ of the intake manifold for receiving a flow of temperature control fluid. The temperature control fluid flowing in channel $116_A$ is directed through heater tube 120 to the heater assembly for providing heating and defrost capabilities in the passenger compartment of the vehicle. The heater assembly is conventional in the art and does not need to be discussed in any further detail.

The second channel $116_B$ in the intake manifold 30 directs a flow of temperature control fluid to a return tube 122. The return tube 122 channels the temperature control fluid either back to the water pump assembly 16 or, more preferably, to a heat exchanger located within the oil pan 28. As shown in FIG. 1, return tube 122 attaches to the oil pan 28 at a first opening 124. Located within the oil pan 28 is a heat exchanger through which the flow of temperature control fluid from the return tube 122 flows. The heat exchanger transfers the heat from the temperature control fluid to the oil thereby assisting in the heating of the oil. A preferred arrangement for utilizing temperature control fluid for heating engine oil is discussed in detail in U.S. application Ser. No. 08/390,711, now abandoned, which has been incorporated herein by reference.

The temperature control fluid is directed out of the oil pan through a second opening 126 and along outlet tube 128. The outlet tube 128 preferably attaches to the inlet tube 18 leading to the water pump 16. Various methods of attaching the two tubes can be practiced within the scope of this invention and are well known to those skilled in the art. Alternately, the outlet tube can attach to a separate opening formed in the water pump 16. In still another alternate embodiment, the return tube 122 could be formed integral with the engine. The engine can be configured with an internal flow path through the cylinder heads and engine block to the oil pan.

Referring again to FIG. 5, a flow control valve is shown positioned on the rightmost portion of the engine, and is generally designated with the numeral 130. The flow control valve 130 controls the flow of temperature control fluid between the cylinder head 26, the intake manifold 30, and the radiator 12. In the preferred embodiment of the invention, the flow control valve is an electronic engine temperature control (EETC) valve, similar to the type disclosed in co-pending U.S. application Ser. No. 08/306,240, now U.S. Pat. No. 5,458,096 which has been incorporated herein by reference. The EETC valve 130 is actuatable between a first or open state and second or closed state. The first or open state permits a substantially unrestricted flow of the temperature control fluid from the cylinder head 26 into the intake manifold 30. In the second or closed state, the EETC valve prevents or inhibits at least a portion of the flow of the temperature control fluid from the cylinder head 26 to the intake manifold 30. Instead, in the second state, at least a portion of the temperature control fluid is directed from the cylinder head 26 into the radiator inlet tube 22 which leads to the radiator 12.

More specifically, when the EETC valve 130 is in its second or closed state, the flow of temperature control fluid from the cylinder head 26 into the channel $116_B$ of intake manifold is inhibited. As a result, preferably little or none of the temperature control fluid flows into return tube 122 and into the water pump 16 or the oil pan 28. Instead this temperature control fluid is directed into the radiator 12. However, the closed position of the EETC valve 130 preferably does not prevent the flow of temperature control fluid along channel $116_A$. As a consequence, the heater assembly (not shown) continues to receive a flow of temperature control fluid. Hence, the heater/defrost capabilities of the system remain generally unaffected by the operation of the EETC valve 130.

Under hot weather conditions, the air flowing through the intake manifold will already be sufficiently preheated (approximately 120 degrees Fahrenheit). Additional preheating by means of the temperature control fluid is, therefore, not needed. Similarly, under hot weather conditions, the engine oil will be operating closer to the optimum engine oil temperature value. Hence, heating of the engine oil with temperature control fluid is also not needed. Accordingly, the EETC valve in the preferred system prevents the flow of temperature control fluid through the channel $116_B$ of the intake manifold.

As stated above, the flow of temperature control fluid along channel $116_A$ is not prevented by actuation of the EETC valve 130. This permits full use of the heating/defrost systems during cold weather conditions. During hot weather conditions, the heater/defrost systems will, naturally, be in their closed positions. Accordingly, there will be no flow of temperature control fluid through the intake manifold, although temperature control fluid will remain within channel $116_A$. This "trapped" temperature control fluid acts as an insulator, reducing the amount of heat which is radiated from the cylinder heads.

Alternately, the EETC valve 130 could be modified to have a third position or state wherein flow along channel $116_A$ is also inhibited when the ambient temperature is above a predetermined value. This would permit the full circulation of the temperature control fluid through the radiator 12 in situations where the heater/defrost capabilities are not likely to be needed (e.g., summertime).

Figure 6A:
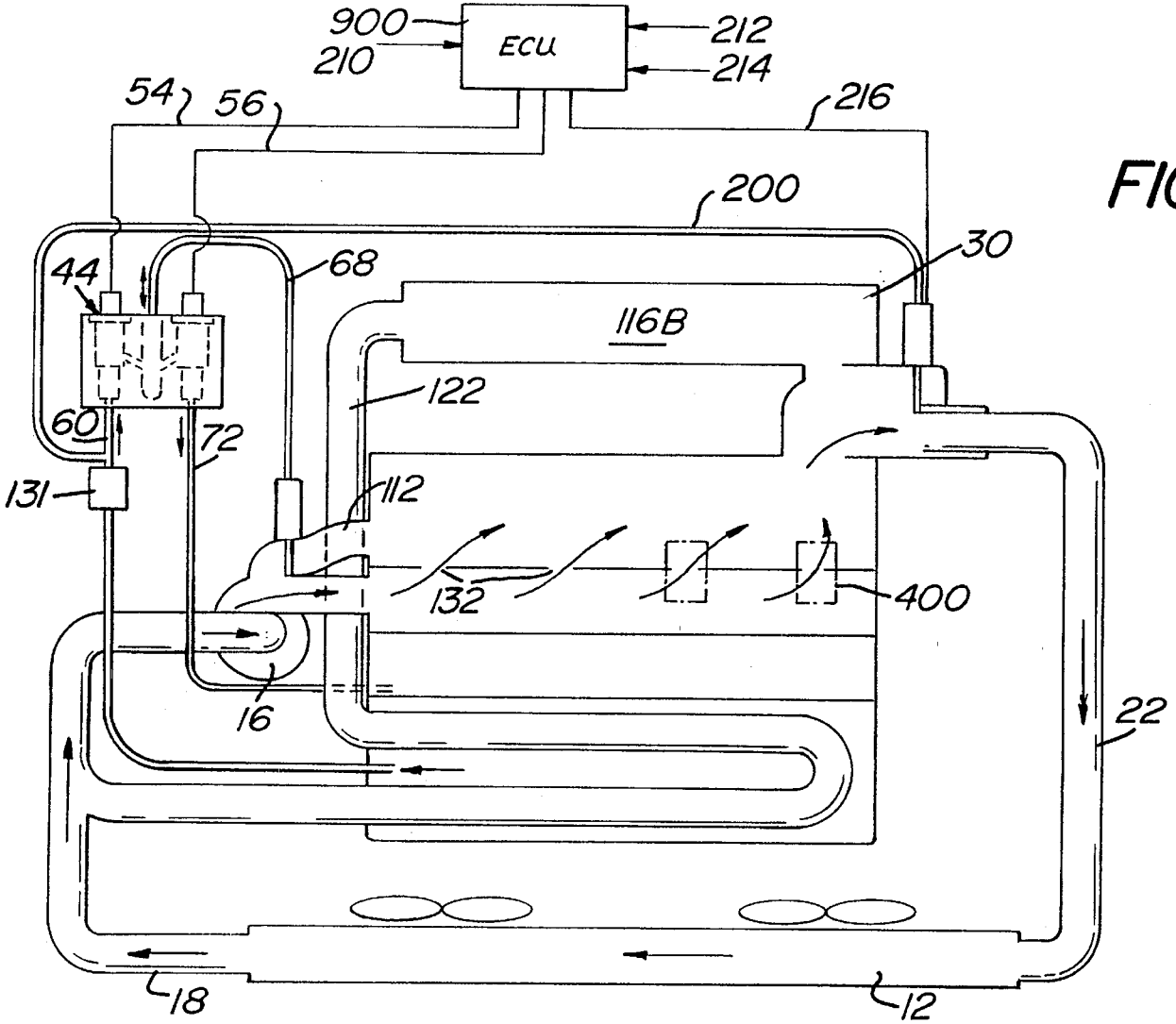
FIG. 6A is a diagrammatical side view of the flow circuit of the temperature control fluid through the engine block, cylinder heads, and radiator in a fully warmed engine according to the present invention.
Figure 6B:
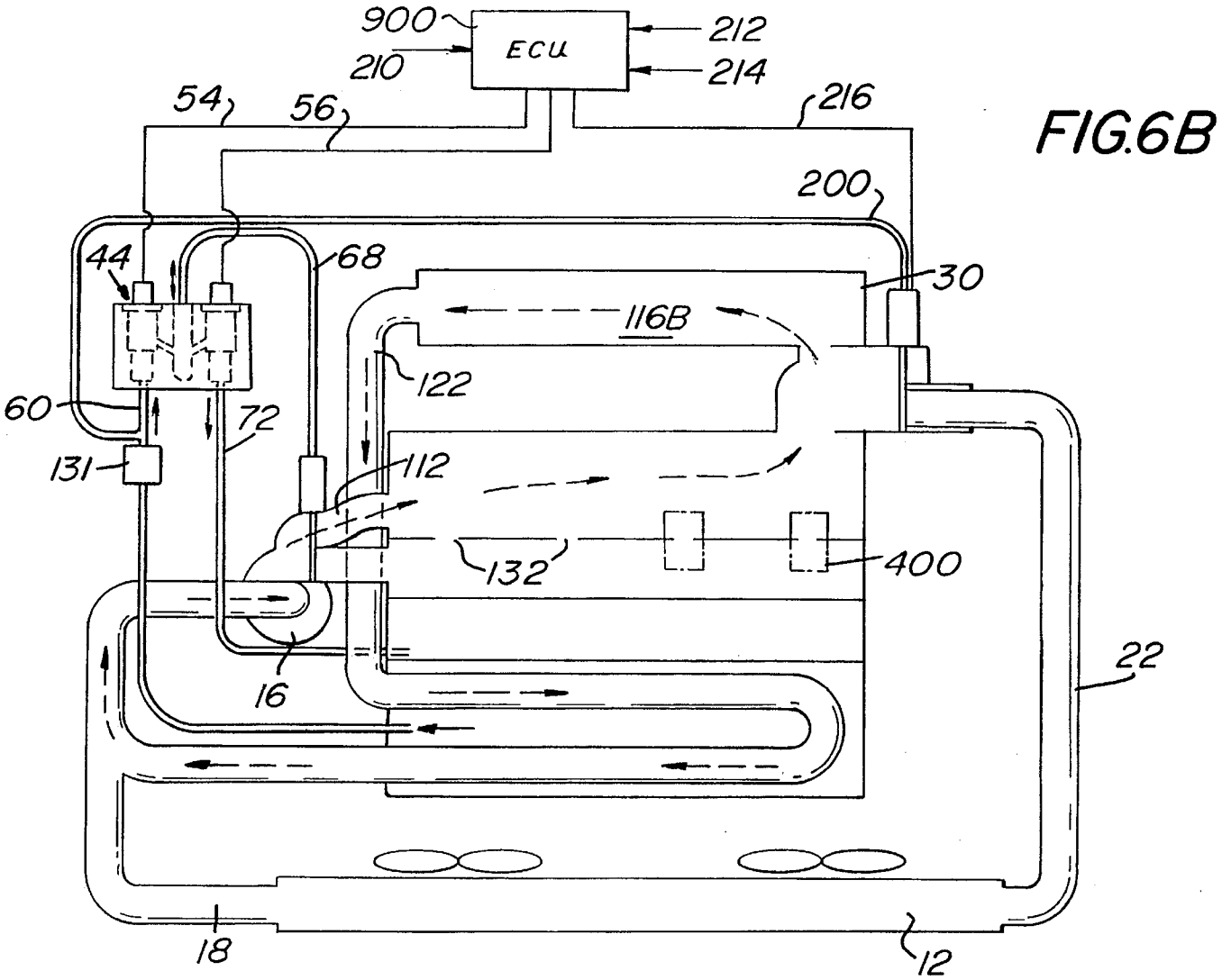
FIG. 6B is a diagrammatical side view of the flow circuit of the temperature control fluid through the cylinder heads, the intake manifold and the oil pan during engine warm-up according to the present invention.

FIGS. 6A and 6B are schematic representations of the fluid flow paths in the preferred embodiment. The solid arrows in FIG. 6A illustrate the flow path of the temperature control fluid during normal operation of the engine when the temperature control fluid is relatively hot and the engine is fully warmed. In this embodiment, the temperature control fluid enters the block 24 from the water pump 16 and passes through a plurality of channels 132 formed between the engine block 24 and the cylinder head 26. The temperature control fluid flows through the cylinder head 26 and into passageway 114. Since the temperature of the temperature control fluid is relatively hot, the EETC valve 130 is in its second or closed position prohibiting temperature control fluid flow into channel $116_B$ of the intake manifold and permitting temperature control fluid flow along radiator inlet tube 22 and into the radiator 12 for cooling. The cooled temperature control fluid is then recirculated back to the water pump 16.

The dashed arrows in FIG. 6B illustrate the flow of temperature control fluid during engine warm up/start up. In this embodiment, the engine is relatively cold and, therefore, it is desirable to heat up the engine as quickly as possible. Accordingly, the preferred temperature control system directs the temperature control fluid through the hottest area of the engine (e.g., cylinder heads) and the areas of the engine which need the heat the most (e.g., intake manifold and engine oil). This results in faster heating of the engine oil and, hence, the faster overall heating of the engine. The flow restrictor valves 40, 42 in the water pump 16 are actuated into their closed or restricted position, preventing the flow of temperature control fluid into the engine block 24. The temperature control fluid is, instead, directed through the bypass passageway 106 and into the cylinder input lines 112. These input lines channel the temperature control fluid directly into the cylinder heads 25 so as to permit quick heating of the fluid. The temperature control fluid then passes though passageway 114. During engine warm up, the EETC valve 130 is in its first or open position preventing or inhibiting flow of temperature control fluid to the radiator 12. The temperature control fluid is permitted to flow along both channels $\mathbf{116}_A$ and $\mathbf{116}_B$ in the intake manifold 30. The fluid in channel $\mathbf{116}_B$ flows into the return tube 122 and, as stated above, is preferably directed through the oil pan 28 to assist in heating the oil up as quickly as possible. The dashed arrows in FIG. 6B illustrate this preferred flow circuit through the oil pan 28 during engine warm up. During extremely cold weather conditions, the circuit illustrated in FIG. 6B may continue for a significant amount of time. It is also conceivable that during a particular operation of the engine, the temperature conditions may prevent the valves from ever closing.

Also shown in FIGS. 6A and 6B is the routing of the hydraulic lines from oil pan 28, which is the preferred hydraulic fluid reservoir/source, to the hydraulic solenoid injector system 44. A filter 131 is shown located along the pressurized hydraulic fluid inlet line. A second line designated 200 is also shown tapping off of the pressurized hydraulic inlet line. This second line feeds pressurized hydraulic fluid to the EETC valve which, preferably, has its own hydraulic solenoid injector system (not shown).

The operation of a preferred system according to the present invention will now be discussed in more detail. When the engine is initially started the oil in the oil pan is typically very cold, as is the engine itself. In order to heat up the oil and the engine toward their optimum operating temperatures, it is desirable to minimize the amount of cooling that is provided by the temperature control fluid. Furthermore, as discussed in the related applications referenced above, it is desirable to direct the heat generated by the combustion of the fuel/air mixture in the cylinders to the locations where the heat is needed the most. The combustion of the fuel/air mixture generates a significant amount of heat in and around the cylinder heads while generating very little heat in the block itself. In order to heat up the engine block, engine oil and intake manifold as quickly as possible, it is desirable to harness the heat generated around the cylinder heads and transfer it in some fashion to these other components. The preferred system controls the flow of temperature control fluid through the engine to efficiently transfer the heat generated in the cylinder heads to the intake manifold and the oil pan. By directing the heat to the intake manifold, the system preheats the intake of the induction air preparing it for proper fuel mixture to provide effective and efficient combustion. Furthermore, by directing the heat from the cylinder heads to the oil pan it is possible to heat the oil towards its optimum temperature as quickly as possible. The engine block will naturally heat up as a consequence of the warmer engine lubricating oil and cylinder piston wall friction.

In order to achieve this warm up operation, the ECU of the present invention utilizes the EETC valve 130 in conjunction with the flow restrictor valves 40, 42 mounted on the water pump 16 to control the flow of temperature control fluid. More particularly, referring to FIGS. 6A and 6B, the ECU 900 receives signals from sensors located in and around the engine which are indicative of the engine operating state and ambient conditions. The ECU 900 utilizes these signals, in combination with predetermined temperature control curves or values, for controlling the state of the valves.

For example, in one embodiment of the invention, the ECU 900 receives signals indicative of the ambient air temperature 210, the engine oil temperature 212, and the temperature control fluid temperature 214. The ECU 900 compares these signals to one or more temperature control curves. In the preferred embodiment, the ECU 900 compares the engine oil temperature 212 to an optimum engine oil temperature curve. The ECU 900 determines the operating state of the engine based on this comparison (e.g., normal, high or extremely high load). The ECU 900 then compares the actual temperatures of the ambient air 210 and the temperature control fluid 214 to a predetermined curve or set of points for determining the desired state or position of the EETC valve 130 and the flow restrictor valves 40, 42. The set of points preferably defines a curve which is a function of at least ambient air temperature and temperature control fluid temperature. A portion of the preferred curve has a non-zero slope. FIGS. 7A through 7F are examples of suitable temperature control curves. U.S. application Ser. No. 08/390,711, now abandoned, discusses in detail the utilization of temperature control curves for controlling the state of EETC and restrictor type valves. The ECU 900 sends control signals along lines 54, 56 to the solenoids 50, 52 to open and close the hydraulic fluid injectors 46, 48. This, in turn, causes the opening and closing of the flow restrictor valves 40, 42 as required. The ECU 900 also sends signals 216 to the solenoids (not shown) of the EETC 130 to place it in its open or closed state as determined by the temperature control curves.

In an alternate embodiment of the invention, the ECU 900 compares the actual oil temperature against an optimum engine oil temperature value or series of values defining a curve. If the actual oil temperature is above the optimum engine oil temperature value, then the ECU 900 adjusts the Normal temperature control curve instead of switching to a High Load curve. Specifically, the ECU 900 shifts the Normal temperature curve downward a predetermined amount so as to reduce the temperature of the temperature control fluid which causes actuation of the valves between their states of positions. In one embodiment of the invention, for every one degree Fahrenheit that the actual engine oil temperature is above the optimum engine oil temperature there is a corresponding two degree Fahrenheit decrease in the temperature control fluid temperature component which produces actuation of the valves. This effectively results in a downward shifting of the temperature control curve. Different engine configurations will, of course, result in different amounts that the temperature control fluid temperature component is shifted downward for a one degree rise in actual engine oil temperature. For example, a one degree rise in actual oil temperature above the optimum oil temperature value may produce a decrease in the actuation temperature of the temperature control fluid within a range of between 1 and 10 degrees. Furthermore, it is contemplated that the amount of downward shifting of the temperature component may not be constant (e.g., the amount of downward shifting may increase as the difference between the actual oil temperature and the optimum oil temperature increases).

In yet another embodiment, the amount of downward shifting of the temperature control fluid temperature component may also vary with changes in ambient temperature. For example, at 0 degrees ambient air temperature, every one degree that the actual oil temperature is above the optimum oil temperature produces a one degree decrease in the temperature control fluid temperature component. At 50 degrees ambient air temperature, every one degree that the actual oil temperature is above the optimum oil temperature produces a two degree decrease in the temperature control fluid temperature component. At 80 degrees ambient air temperature, every one degree that the actual oil temperature is above the optimum oil temperature produces a three degree decrease in the temperature control fluid temperature component. This embodiment of the invention may be graphically illustrated as shown in FIG. 7F wherein a control curve is selected by the ECU depending on the sensed ambient temperature. Although linear curves are illustrated in the exemplary embodiment, it should be understood that alternate non-linear curves may be incorporated for each ambient temperature. It is also contemplated that a single curve may be utilized for shifting the temperature control curve. One axis of the plot would represent the sensed ambient temperature. The second axis would represent the ratio of a one degree increase in engine oil over the corresponding downward shifting of the temperature control curve (e.g., 1/1, 1/2 or 1/3).

Alternately, it may be preferable to wait until the actual oil temperature exceeds the optimum oil temperature value by a set amount before altering the temperature control curve. For example, for every 3 degree increase in the actual engine oil temperature above the optimum oil temperature value there is a corresponding decrease in the set point temperature of the temperature control fluid which directs actuation of the valve.

Figure 7A:
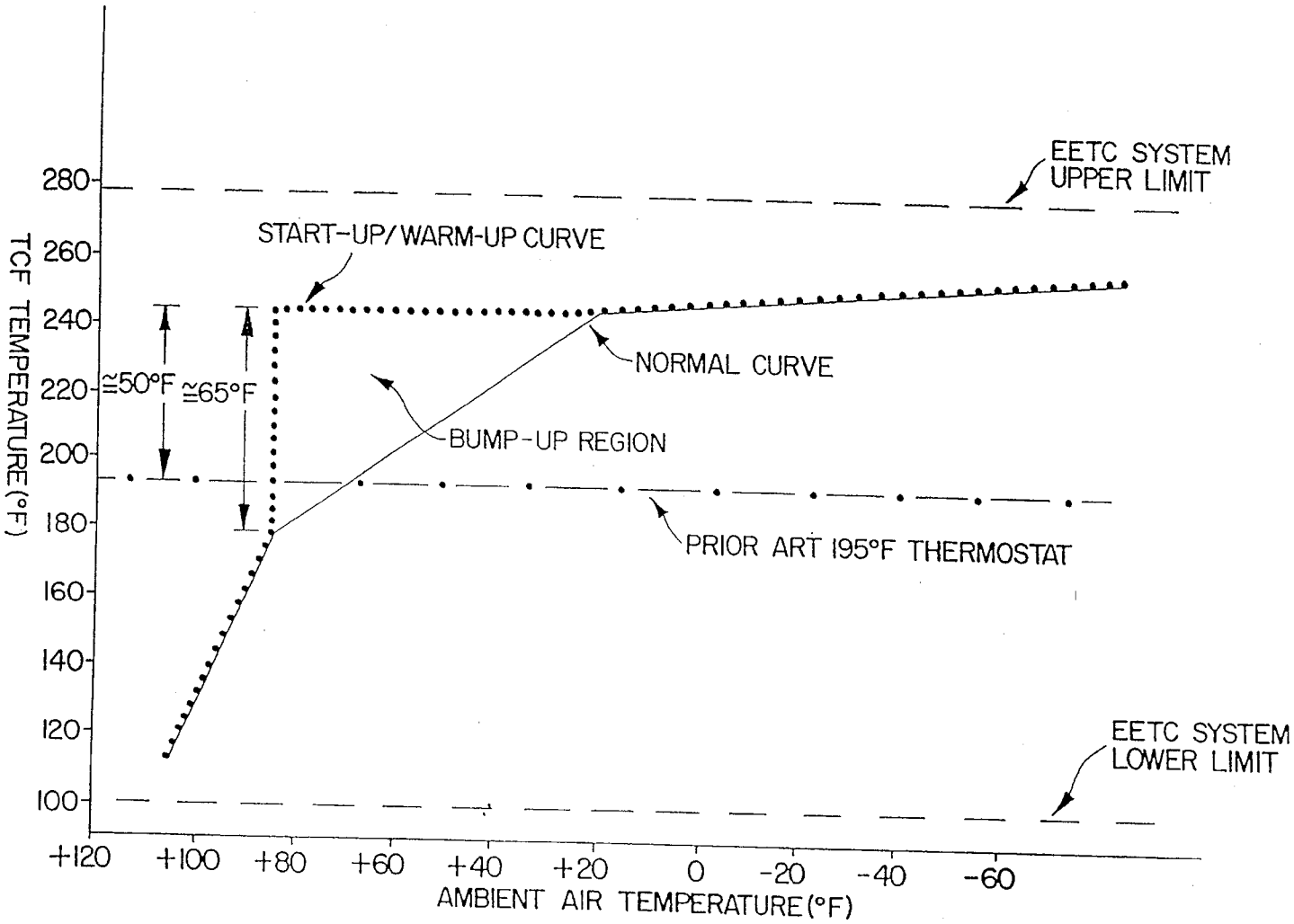
FIG. 7A through 7G are embodiments of the temperature control curves useful in controlling the opening and closing of the valves in the present invention.
Figure 7B:
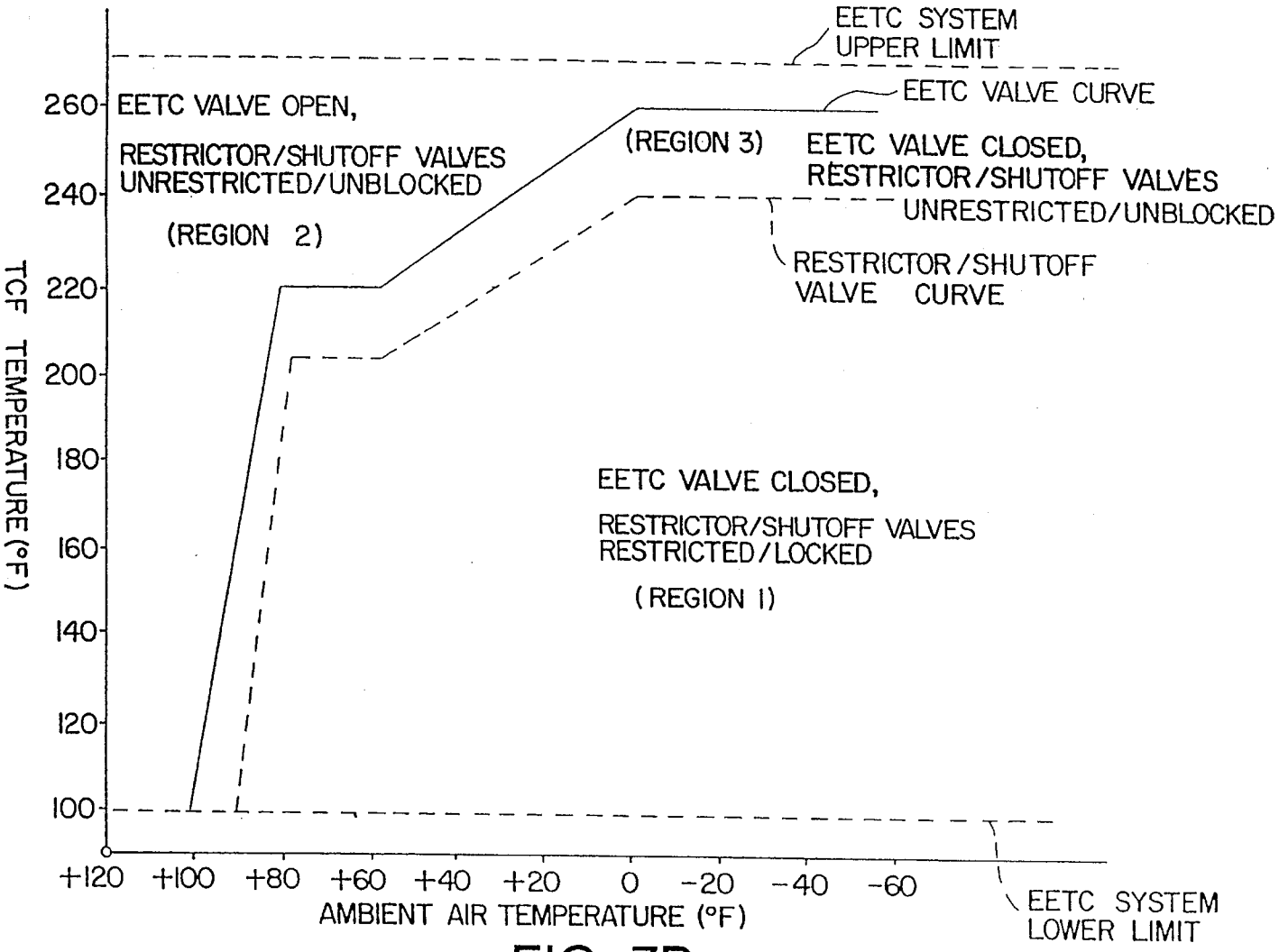
Figure 7C:
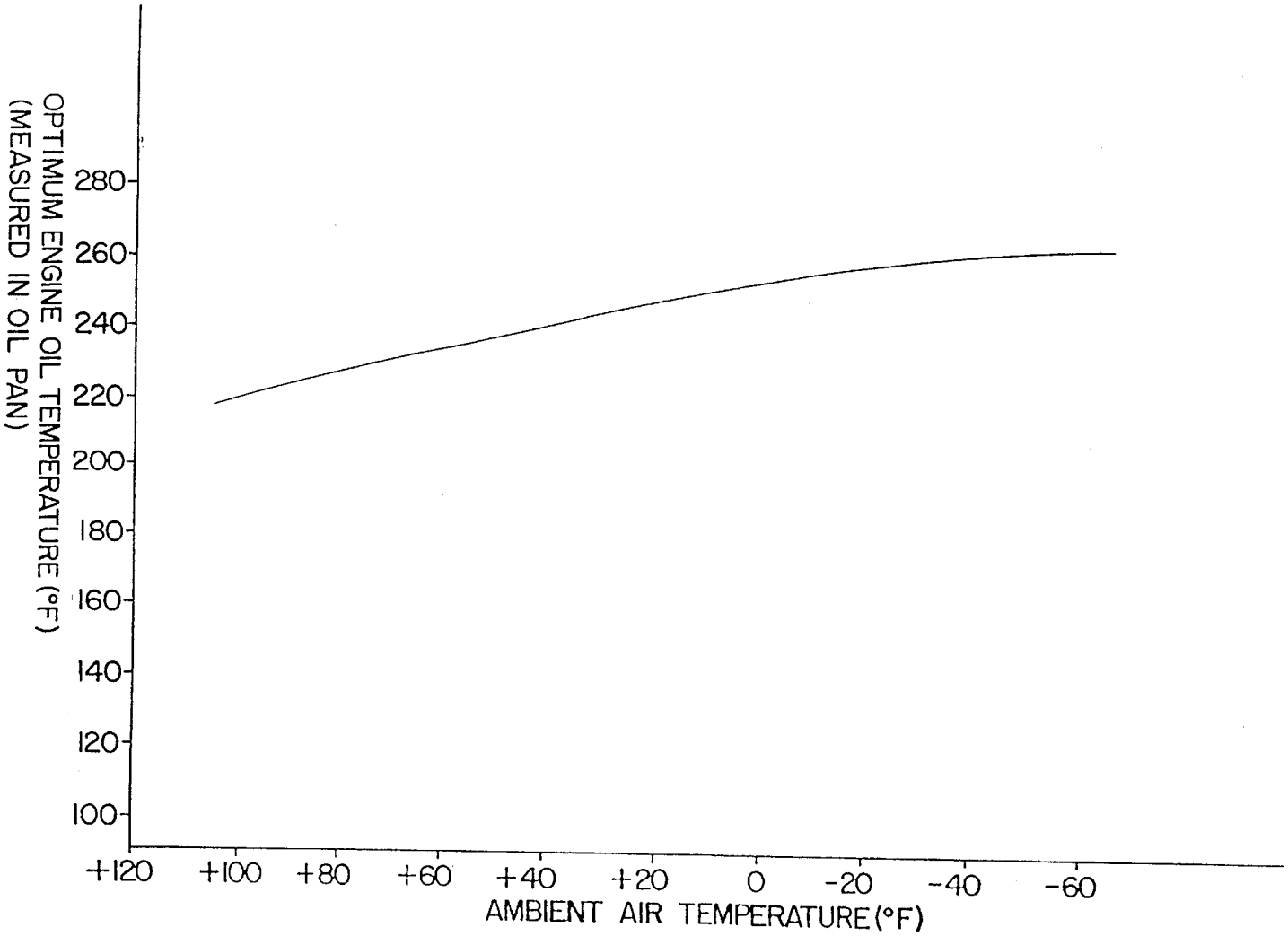
Figure 7D:
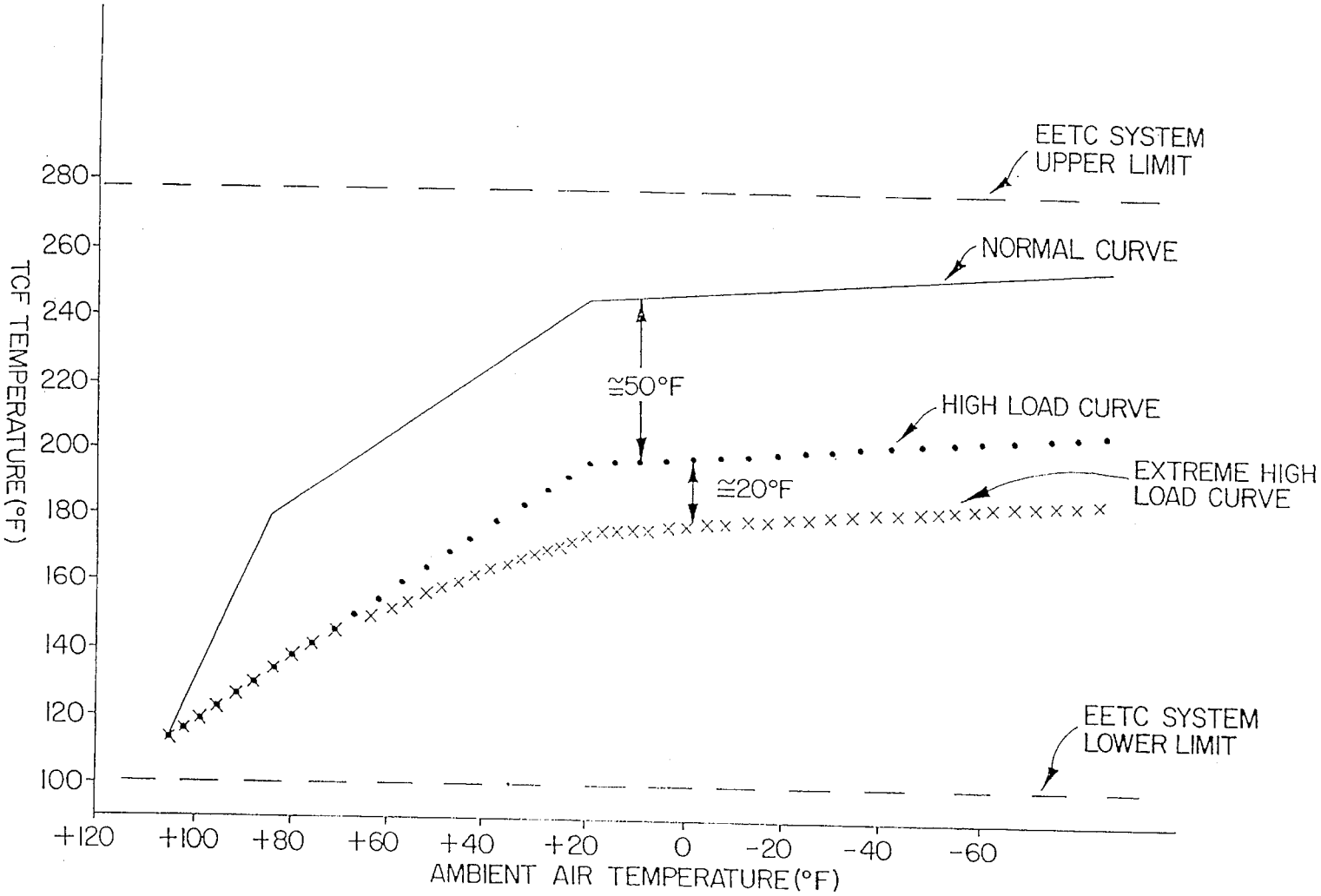
Figure 7E:
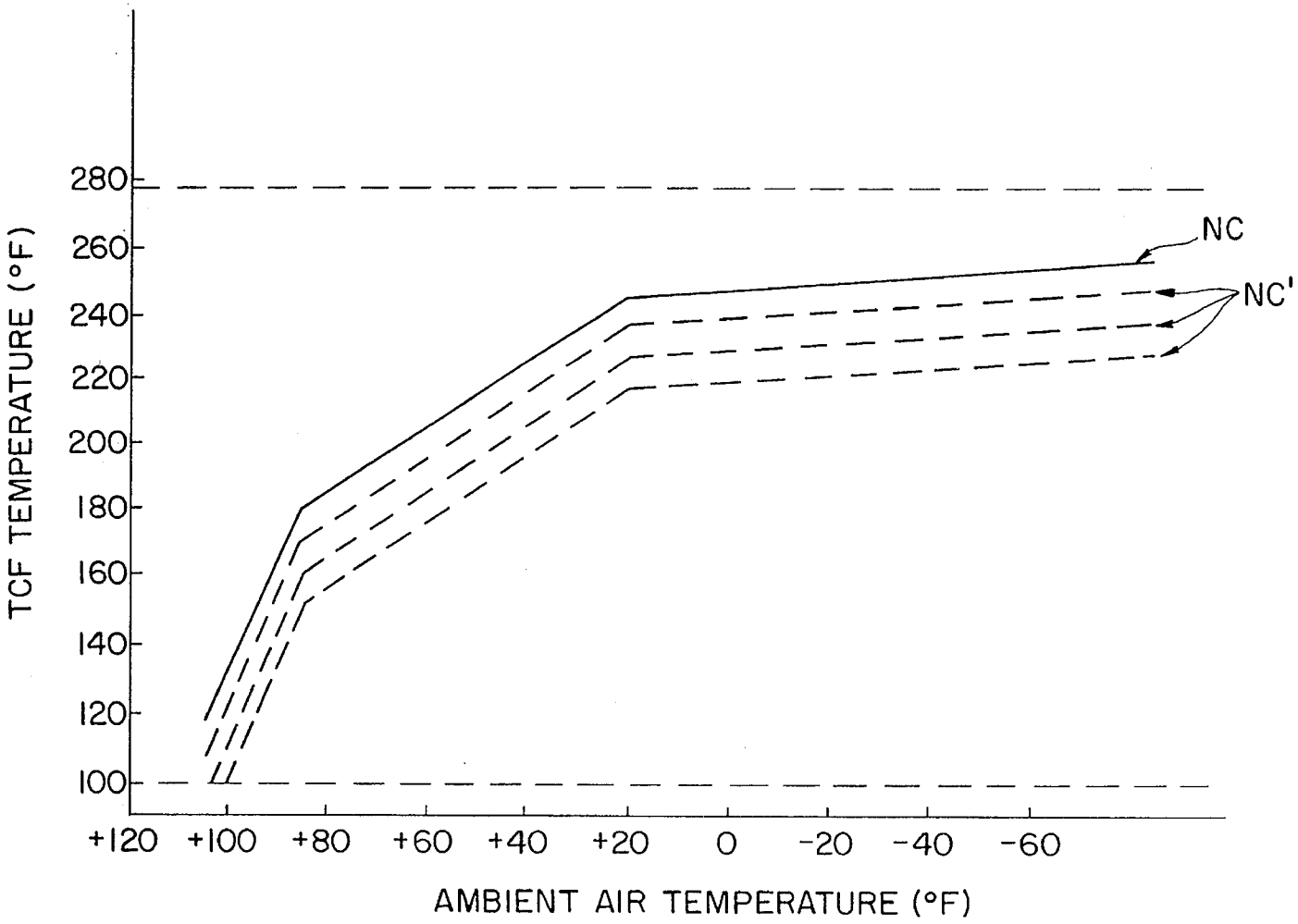
Figure 7F:
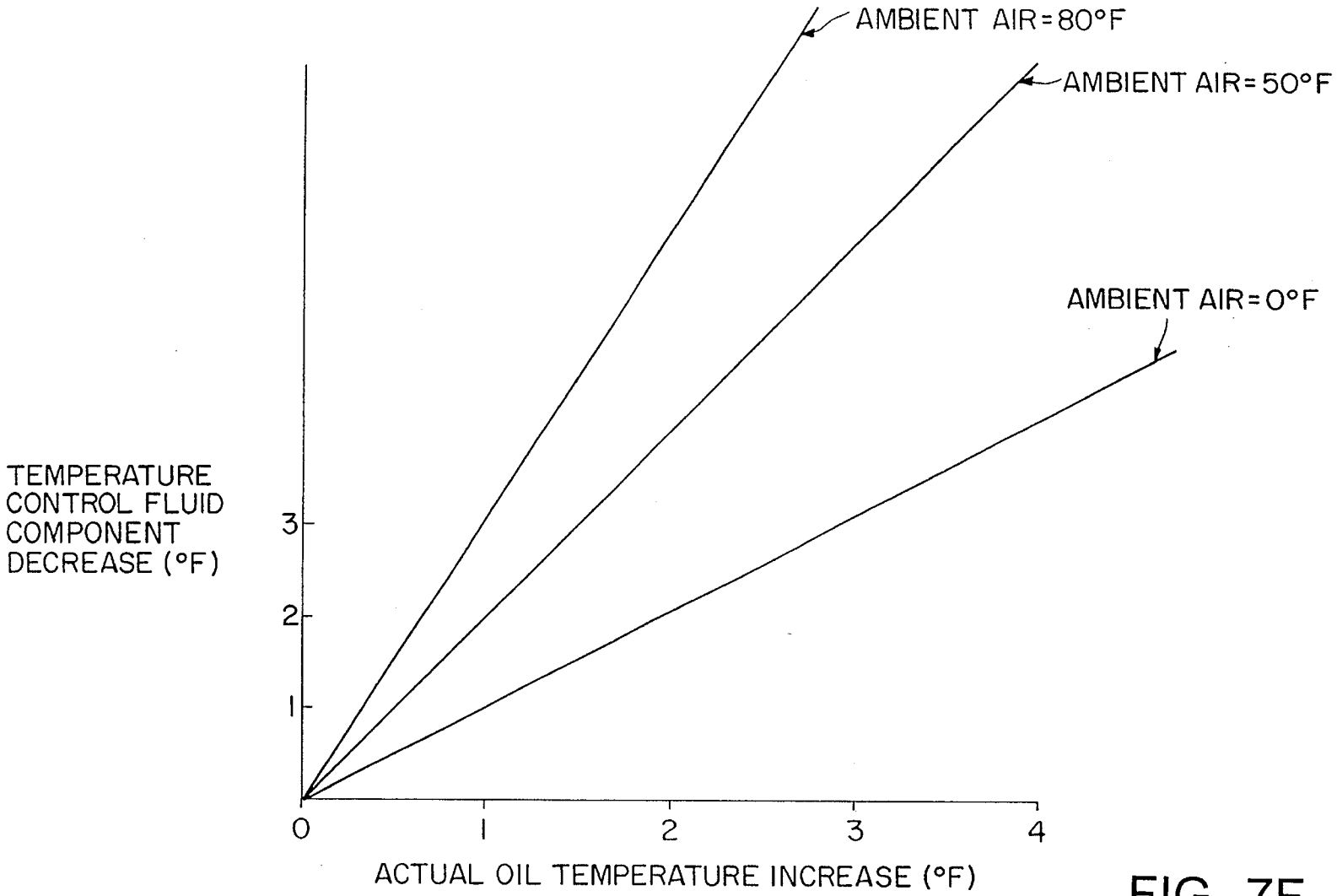

FIG. 7E graphically illustrates this aspect of the invention. A series of identical temperature control curves are shown for a plurality of actual sensed engine oil temperatures. Each dashed line (NC') represents a shifted-down version of the solid "normal" temperature control curve (NC). It should be readily apparent that only one particular curve or value would be utilized for a given sensed engine oil temperature. In an alternate arrangement, an equation and/or scaling factor instead of a separate curve may be utilized to alter the value at which actuation occurs according to the normal curve.

In many instances, altering the temperature control fluid component based only on the amount that the actual engine oil temperature exceeds the optimum engine oil value would be sufficient. However, in the preferred embodiment, it is also desirable to monitor the engine load to determine how much altering of the temperature control curves is required to maintain the actual engine oil temperature at or near the optimum oil temperature.

Figure 7G:
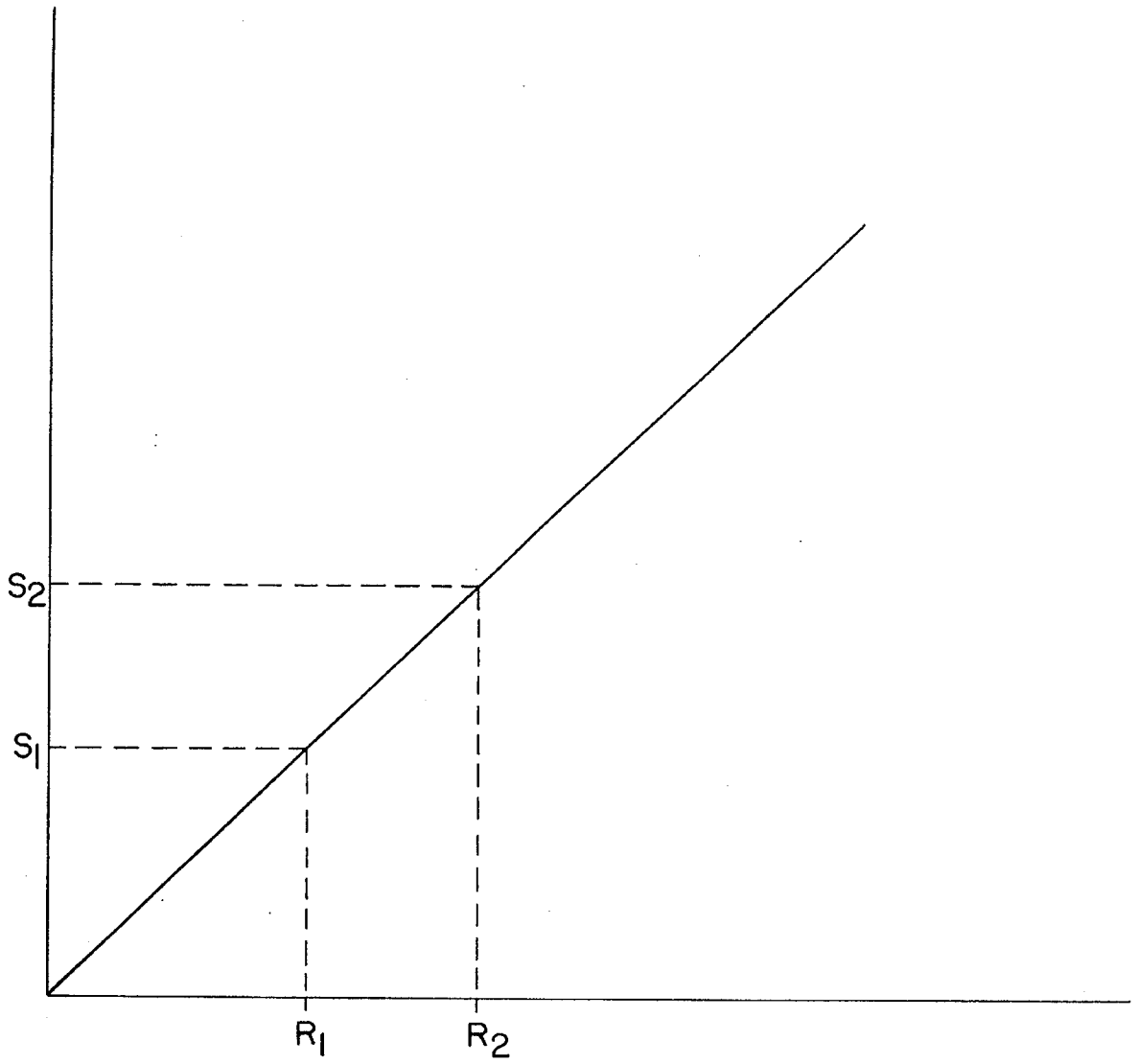

One method for varying or altering the temperature control curve is by monitoring the rate of change of the actual engine oil temperature. Referring to FIG. 7G, an exemplary curve is illustrated which depicts the rate of change of the actual engine oil temperature versus the scaling factor for the temperature control fluid component and/or for determining the downward shifting of the temperature control curve. If the detected rate of change of the actual oil temperature is relatively low ($R_1$), the downward shifting of the temperature control curves is also small ($S_1$). If, on the other hand, the detected rate of change of actual oil temperature is large ($R_2$) which is indicative of a high loading condition, then the downward shifting of the temperature control curve is also relatively large ($S_2$). Although the exemplary curve depicts a linear curve other curve shapes, such as exponential, logarithmic, curvilinear, etc., may be substituted therefor. Furthermore, a step function may instead be utilized which provides a different amount of downward shifting of the temperature control curve for different detected rates of change of the actual engine oil.

During use, when the engine computer detects that the actual sensed oil temperature exceeds the optimum oil temperature, the computer then determines rate of change of the actual engine oil temperature. The engine computer determines a scaling factor from this rate of change. The scaling factor is then applied to the normal temperature curve to shift the curve downward. The engine computer continues to monitor the rate of change in the actual oil temperature and shifts the temperature control curve accordingly. Delays can be incorporated into the system to minimize the amount of shifting of the temperature control curve that occurs.

Figure 7H:
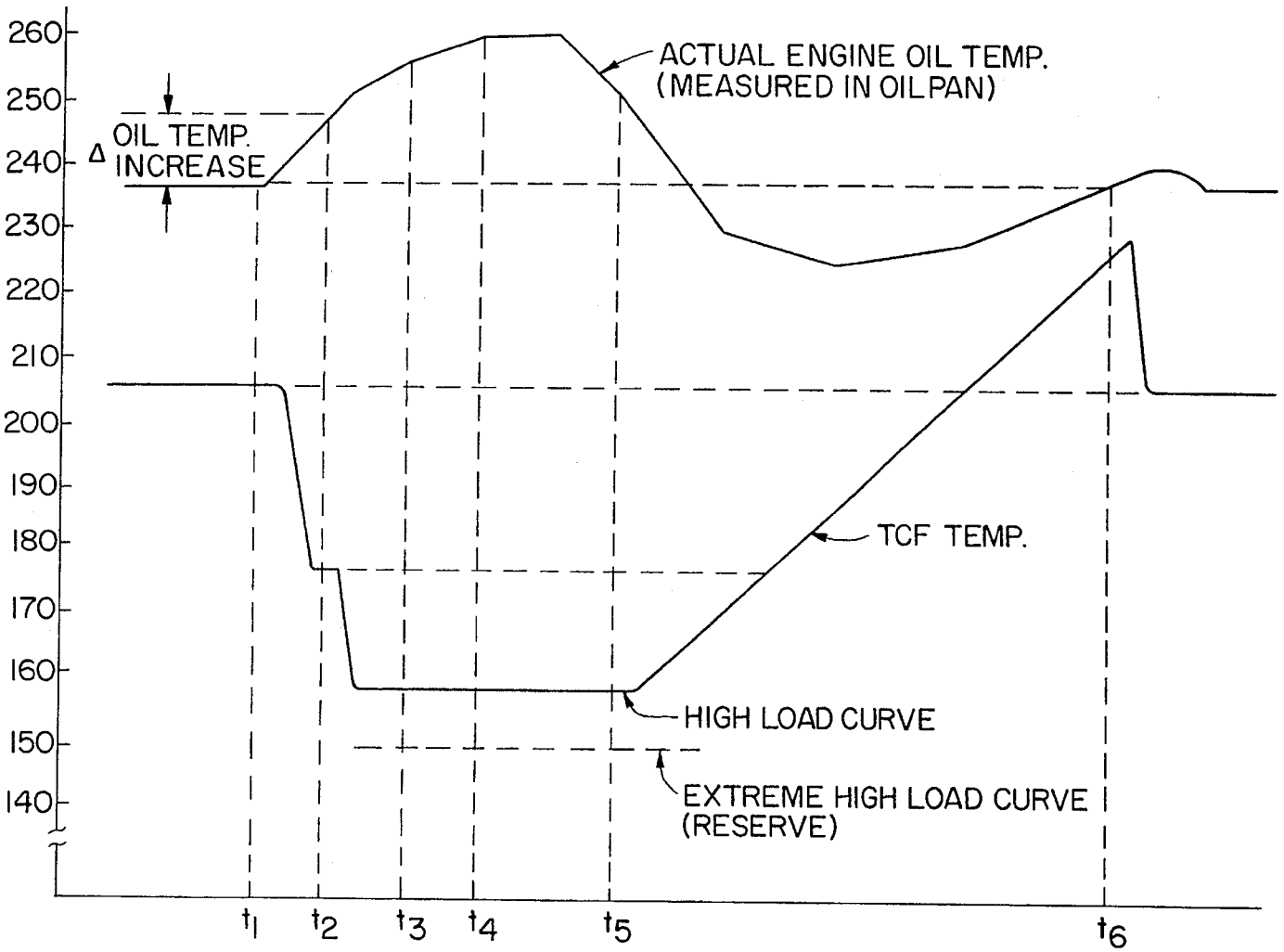
FIG. 7H is a plot of the actual engine oil temperature when the temperature control curve is shifted according to the present invention.

An analytically determined curve illustrating the effect of the above embodiment is shown in FIG. 7H. The curve shown is for a constant ambient temperature of 60° F. From time $t_0$ to time $t_1$, the engine computer controls the opening and closing of the EETC valve and restrictor valves according to a normal temperature control curve (level 1). At time $t_1$, the engine computer detects an increase in the actual oil temperature above the optimum engine oil temperature value (approximately 235° F. in the illustrated embodiment) which is preferably determined from an optimum engine oil temperature curve similar to the one shown in FIG. 7C. This is indicative of an increase in engine load. The engine computer either applies a predetermined factor for downward shifting of the temperature control curve (e.g., 2 degree drop in TCF for each 1 degree rise in engine oil temperature) or, more preferably, the engine computer determines a rate of change of the engine oil temperature and from that rate calculates the amount of downward shifting of the temperature control curve required.

The EETC valve is opened according to the new shifted temperature control curve (level 2), causing the immediate drop in the temperature control fluid as shown between time $t_1$ and $t_2$. The engine oil however, will continue to rise until the cooling effect of the temperature control fluid begins to cool the engine oil.

The engine computer continues to monitor the actual engine oil temperature. At time $t_2$, the temperature of the temperature control fluid stabilizes at the new shifted temperature control fluid valve. If the actual engine oil is still above the optimum engine oil temperature, the engine computer determines the rate of change of engine oil temperature between time $t_1$ and $t_2$. The high rate of change indicates a continued high engine load condition. Accordingly, based on this determined rate, the engine computer determines an additional amount of downward shifting of the temperature control curve that is required. The EETC valve is then controlled based on the this second shifted temperature control curve (level 3).

At time $t_3$ the engine computer determines a rate of change of the engine oil temperature between time $t_2$ and $t_3$. Since the new rate of change in the illustrated example is less than the previous rate of change, the engine computer does not shift the temperature control curve downward. Instead, the engine computer continues to control the EETC valve based on the level 3 temperature control curve.

At time $t_5$ the engine computer determines a rate of change of the engine oil temperature between time $t_4$ and $t_5$. Since the new rate of change in the illustrated example is decreasing, the engine computer shifts the temperature control curve upward back toward the first or normal level. As a result, the temperature control fluid temperature continues to heat up while the engine oil decreases in temperature and begins to return to its optimal operating temperature.

Since the reheating of the temperature control fluid is a slow process, as illustrated by the time period between time $t_5$ and $t_6$, it is important not to drop the temperature control fluid to an unnecessarily low temperature so as to maintain the engine oil as close to the optimum engine oil as possible.

It should be understood that the sensed ambient air temperature will affect rate or slope of the temperature control fluid temperature curve in FIG. 7H. For example, at hot ambient temperatures, the temperature slope of the temperature control fluid between time $t_5$ and $t_6$ will be steeper than at low ambient temperatures. This is due to the fact that at lower temperatures (e.g., zero degrees ambient) it is more preferable that the engine oil remains at a higher temperature for a longer period of time to increase heater and defroster capabilities. The cold ambient temperature reduces the likelihood that the engine oil will become excessively hot. In warmer ambient temperatures, it is desirable to maintain the engine oil closer to its optimum valve so as to prevent overheating. The temperature slope of the temperature control fluid is, thus, steeper at these warmer temperatures.

An alternate method for determining the engine load is by monitoring the intake manifold vacuum pressure. The sensed intake manifold pressure generally provides an accurate indication of the current engine load. For example, if the sensed intake manifold vacuum is less than about 4 inches Hg, the engine is operating under a high load condition. Accordingly, a first predetermined scaling factor or curve can be selected for reducing or replacing the temperature control curve. If, however, the intake manifold vacuum is less than about 2 inches Hg, then the engine is operating under an extremely load condition. In this case, a second scaling factor or curve is selected for varying the normal temperature control curve.

Another method for determining engine load is through the monitoring of the commanded engine acceleration. For example, a high commanded engine acceleration is indicative of a high engine load condition. The amount of engine acceleration can be determined from a variety of methods, such as the accelerator pedal displacement, a signal from the fuel injection system, etc. Depending on the commanded acceleration, a predetermined factor and/or curve is selected for varying the normal temperature control curve.

In both the commanded engine acceleration method and the intake manifold air pressure method, a rate monitoring system similar to the one discussed above with respect to the engine oil temperature could also be incorporated to further optimize these methods.

Based on the above discussion, those skilled in the art would readily understand and appreciate that various modifications can be made to the exemplary embodiments disclosed and are well within the scope of this invention. For example, the temperature control curves themselves may be replaced by one or more equations for controlling the actuation of the valves. In yet another embodiment, fuzzy logic controllers could be implemented for controlling the actuation of the valves and/or varying of the temperature control curves.

The varying or downward shifting of the temperature control curves as discussed above is preferably limited to between approximately 50° F.–70° F. This is intended to prevent substantial degradation in the capabilities of the heater/defroster systems by maintaining the temperature control fluid at a reasonably high temperature.

Referring back to FIG. 4, inhibiting the flow of temperature control fluid through the engine block 24 and through the radiator 12 results in a temperature control fluid circuit which transfers heat from the cylinder heads 26 through the intake manifold 30 and into the oil pan 28. The dashed arrows in FIG. 4 indicate the flow path or circuit of the temperature control fluid during engine warm up. As stated above, the flow path transitions through the cylinder heads 26, the intake manifold 30, the oil pan 28 and back to the water pump 16. The closed state of EETC valve 130 prevents flow of temperature control fluid to the radiator 12 and the restricted positions of the flow restrictor valves 40, 42 prevent flow of temperature control fluid into the engine block 24.

Although there is no flow of temperature control fluid in the engine block 24, there is still a substantial amount of fluid already present in the block. Since there is no pressure forcing the fluid in the engine block 24 to circulate, it will not flow up through the channels 132 formed between the water jackets of the engine block 24 and the cylinder heads 26. The flow of temperature control fluid through the cylinder heads 26 and over the channels 132 functions effectively as a dam to further prevent the flow of temperature control fluid from the engine block 24 into the cylinder heads 26. A significant quantity of temperature control fluid is, therefore, trapped within the engine block 24 and naturally heat up on its own. The reduced amount or mass of temperature control fluid which is circulated by the preferred system around the engine during warm-up/start-up will heat up quicker and, accordingly, heat the engine and oil up significantly faster. In actuality, the temperature control fluid trapped within the engine block acts as an "insulator" to retain valuable heat within the engine circuit. It is expected that the temperature of the temperature control fluid entering the cylinder heads (after circulation through the engine oil pan and water pump) will be approximately 30° F. to 50° F. warmer than the temperature of the temperature control fluid trapped within the engine block water jacket. This should be low enough to prevent "thermal shock" yet be significant enough to improve engine warm-up for better engine out exhaust emissions and fuel economy especially for short durations of engine operation, e.g., delivery vans, etc.

In a GM 3800 V6 engine, the preferred configuration reduces the mass of temperature control fluid circulating by between approximately forty to fifty percent during warm-up. This results in the quicker heat up of the engine towards its optimum operating temperature, yielding reduced exhaust emissions and quicker heater/defrost capabilities. Also, by raising the temperature of the oil in the oil pan to above 195° Fahrenheit, it is possible to reduce or eliminate sludge buildup and also maintain the engine oil at or near its optimum temperature. This should result in better extreme cold weather fuel economy.

As stated above, an EETC valve is the preferred valve for controlling the flow of temperature control fluid between the engine and the radiator. While an EETC valve has been chosen as the preferred valve, other valves may be utilized in its stead for controlling the fluid flow between the engine and the radiator. A standard thermostat could also be used in place of the EETC valve disclosed above. However, since a thermostatic valve is limited to controlling the flow of fluid based on the temperature of the fluid, it is not designed to maintain the temperature of the engine oil at or near its optimum temperature. Accordingly, it is not a preferred valve.

Referring back to FIG. 6B, after the ECU 900 determines that the engine has warmed up and the oil is running at or near its optimum temperature, the EETC valve 130 is actuated into its second or closed position so as to permit flow of temperature control fluid from the cylinder heads 26 toward the radiator 12. Furthermore, at some point after the engine has begun to warm up, the flow restrictor valves 40, 42 are actuated into their open or unrestricted position which inhibits flow of temperature control fluid into the bypass passageway 106 and, instead, permits flow of temperature control fluid along flow channels 80, 82 of the water pump 16. This permits the flow of temperature control fluid to enter into the block inlet ports 36, 38. The flow of temperature control fluid in this mode of operation is indicated by the solid arrows in FIG. 6A. The fluid flows directly into the engine block 24 and through the series of channels 132 formed between the engine block 24 and the cylinder head 26 as shown.

It is also contemplated that one or more restrictor valves may be incorporated into the engine block 24 to reduce the flow of temperature control fluid through the channels 132 between the block and the cylinder head to further optimize the system. FIGS. 6A and 6B illustrate two restrictor valves in phantom (identified by the numeral 400) positioned within the engine block 24. Suitable restrictor valves are discussed in co-pending U.S. application Ser. No. 08/306,281, now U.S. Pat. No. 5,463,986.

Another feature of the invention involves the utilization of the heat present in the engine exhaust to further heat the temperature control fluid. As discussed above, approximately one third of heat generated during the combustion of the fuel/air mixture is transferred through the exhaust system. The present invention utilizes the heat in the exhaust gases to assist in heating up the temperature control fluid during warm-up of the engine. Accordingly, the increased temperature of the temperature control fluid helps to bring the engine and the engine oil up to their optimum operating temperatures significantly faster than prior art systems. The present invention has particular use in diesel engines where the additional heat significantly increases the engine efficiency.

Figure 9:
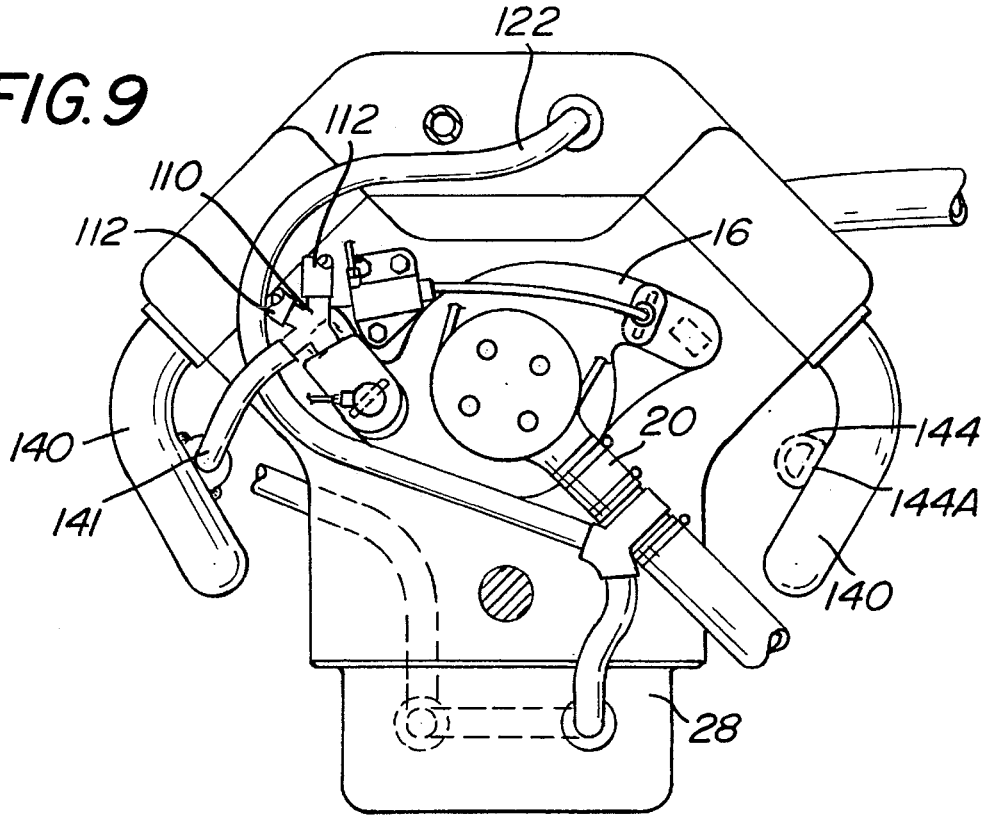
FIG. 9 is side view of the invention taken along lines 9—9 in FIG. 8 and illustrates the shape of the heating conduit and one method of attaching the exhaust heat assembly to the engine.
Figure 8:
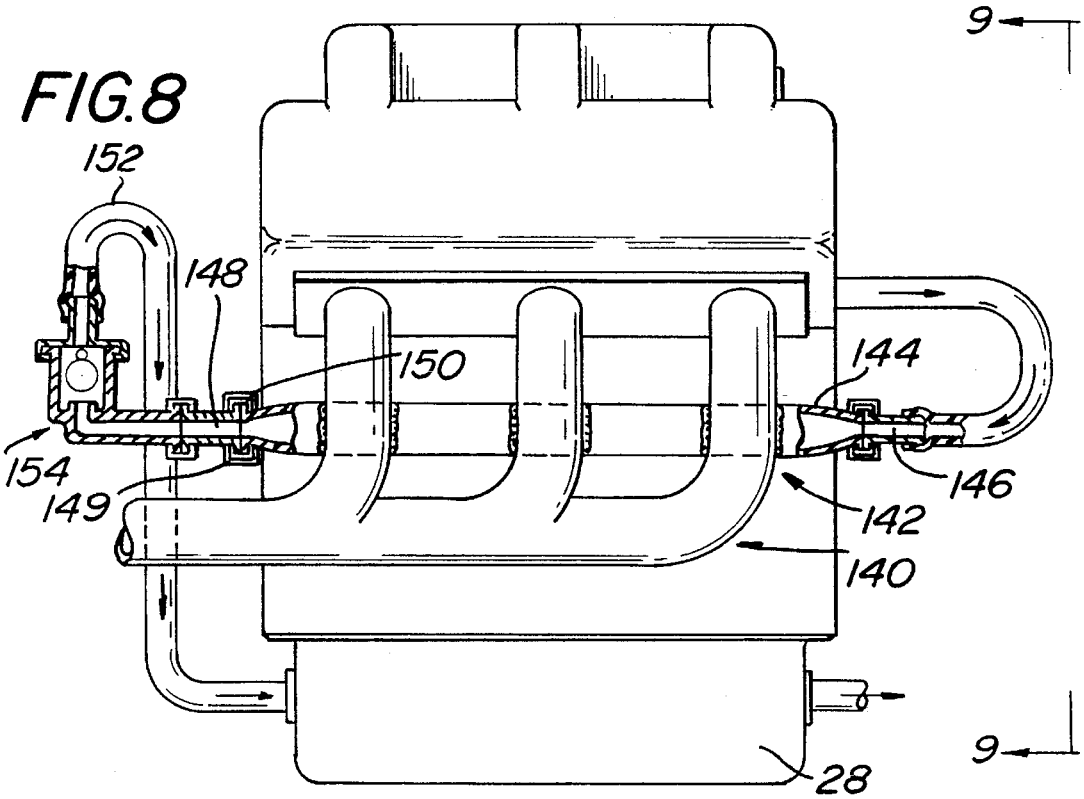
FIG. 8 is one embodiment of the novel exhaust heat assembly according to the present invention.

FIGS. 8 and 9 illustrate an embodiment of the invention which incorporates a novel means for harnessing the heat of the exhaust gases. In this embodiment, the bypass tube 110, which leads from the water pump 16 and connects to the cylinder head input lines 112, is split so as to direct at least a portion of the temperature control fluid flow to the exhaust manifold 140 along the exhaust input tube 141. The exhaust input tube 141 attaches with an exhaust heat assembly generally designated 142.

The exhaust heat assembly 142 extends along or adjacent to at least a portion of the exhaust manifold 140. The exhaust heat assembly 142 includes a heating conduit 144 that is directly in contact with or adjacent to the exhaust manifold 140. The heat from exhaust gases in the exhaust manifold 140 is conducted through the walls of the exhaust manifold 140 and the heating conduit 144 and into the temperature control fluid. In order to maximize the amount of heat transfer into the temperature control fluid, it is preferable that the heating conduit 144 be shaped so as to conform to the exhaust manifold 140. For example, as illustrated, the side $144_A$ of the heating conduit 144 which is directly in contact with the exhaust manifold 140 is preferably configured relatively large in size so as to permit a significant amount of heat transfer into the heating conduit 144. The heating conduit 144 is made from material which is capable of withstanding the excessive temperatures which exist in and/or around the exhaust manifold 140. However, the material chosen must also be capable of readily transferring the heat from the exhaust manifold 140 to the temperature control fluid which flows within the heating conduit 144. In the preferred embodiment, the heating conduit is made from stainless steel, and has a wall thickness of approximately 0.090 inches. The shape of the heating conduit 144 will vary depending on the engine exhaust manifold configuration.

Since the heating conduit 144 is exposed to the excessive temperatures of manifold, it is likely to also be at an excessively high temperature. Accordingly, it is not desirable to attach the exhaust input tube 141, which contains the temperature control fluid and which is typically made from a rubber material, directly to the heating conduit 144. Instead, the exhaust heat assembly 142 preferably includes a first spacer 146 which is located between the heating conduit 144 and the exhaust input tube 141. The first spacer 146 is preferably made from a non-conductive or minimally conductive material such as ceramic. The exhaust input tube 141 attaches to the first spacer 146 in conventional fashion so as to permit the flow of temperature control fluid into the inlet of the heating conduit 144. Furthermore, in order to dissipate the heat of the heating conduit 144 slightly before engaging with the spacer 146, the heating conduit 144 extends approximately six inches on either side of its engagement with the exhaust manifold 140.

The outlet side of heating conduit 144 attaches to a second spacer 148, which is also preferably made from ceramic material. The second spacer 148 directs the flow of temperature control fluid from the heating conduit 144 to an exhaust return tube 152. The exhaust return tube 152 conveys the heated temperature control fluid into either the water pump 16 or, more preferably, into the oil pan 28 for transferring the heat from the temperature control fluid to the engine oil. If, as is preferred, the heated temperature control fluid is directed to the oil pan 28, then the return tube 122 from channel $116_B$ of the intake manifold 30 does not also need to be directed through the oil pan 28. Instead, the return tube 122 can attach directly to the inlet 20 of the water pump 16.

A crimp joint 149 is utilized to attach the spacers 146, 148 to the heating conduit 144. The crimp joint 149 includes a soft metallic seal 150, such as copper or high temperature synthetic material.

In the preferred embodiment of the exhaust heat assembly 142, a valving arrangement 154 is located between the second spacer 148 and the exhaust return tube 152. The valving arrangement is designed to permit temperature control fluid flow in only one direction. That is, the valving arrangement 154 permits the heated temperature control fluid to flow from the heating conduit 144 into the exhaust return tube 152 and toward the oil pan and/or water pump 16. The valving arrangement 154, however, does not permit the temperature control fluid to flow back into the heating conduit 144. This is particularly important when the flow of temperature control fluid into the exhaust heat assembly 142 is shut off, such as after the engine oil has been warmed to a predetermined temperature. In this operational mode, the flow restrictor valves 40, 42 will be in their open state, inhibiting flow of temperature control fluid into the exhaust input tube 141 and, accordingly, the exhaust heat assembly 142. However, there is ordinarily no valve to stop the flow of temperature control fluid from the water pump 16 back along the exhaust return tube 152 to the exhaust heat assembly 142. The valving arrangement 154 of the present invention prevents any back flow of temperature control fluid from entering the heating conduit 144.

In the embodiment illustrated, a check ball valve is the valve of choice, although a spring type flapper valve could readily be substituted without detracting from the invention. Since the valving arrangement is separated from the heating conduit 144 by a ceramic spacer 148, the valve will not experience extreme temperatures. Therefore, it can be made from a lightweight material such as glass-filled nylon or aluminum.

While the above embodiment directs substantially the entire flow of temperature control fluid flowing through the exhaust heat assembly 142 into the oil pan 28, it is also possible to split the flow of temperature control fluid in the exhaust return tube 152, such that a portion of the flow is directed towards the oil pan 28 with the remainder of the flow directed into the water pump 16 or through another engine preheat system, such as an air induction preheat system. Those skilled in the art should readily appreciate that various modifications to this system can be practiced within the scope of this invention.

Figure 11:
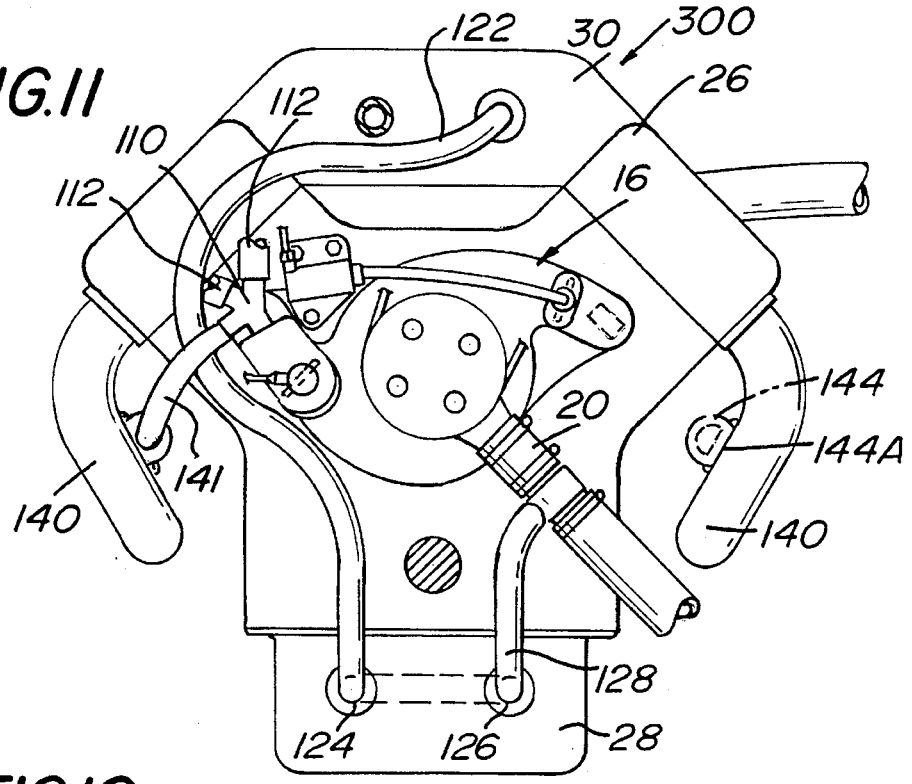
FIG. 11 is side view of the invention taken along lines 11—11 in FIG. 10 and illustrates another method of attaching and routing the exhaust heat assembly to the engine.
Figure 10:
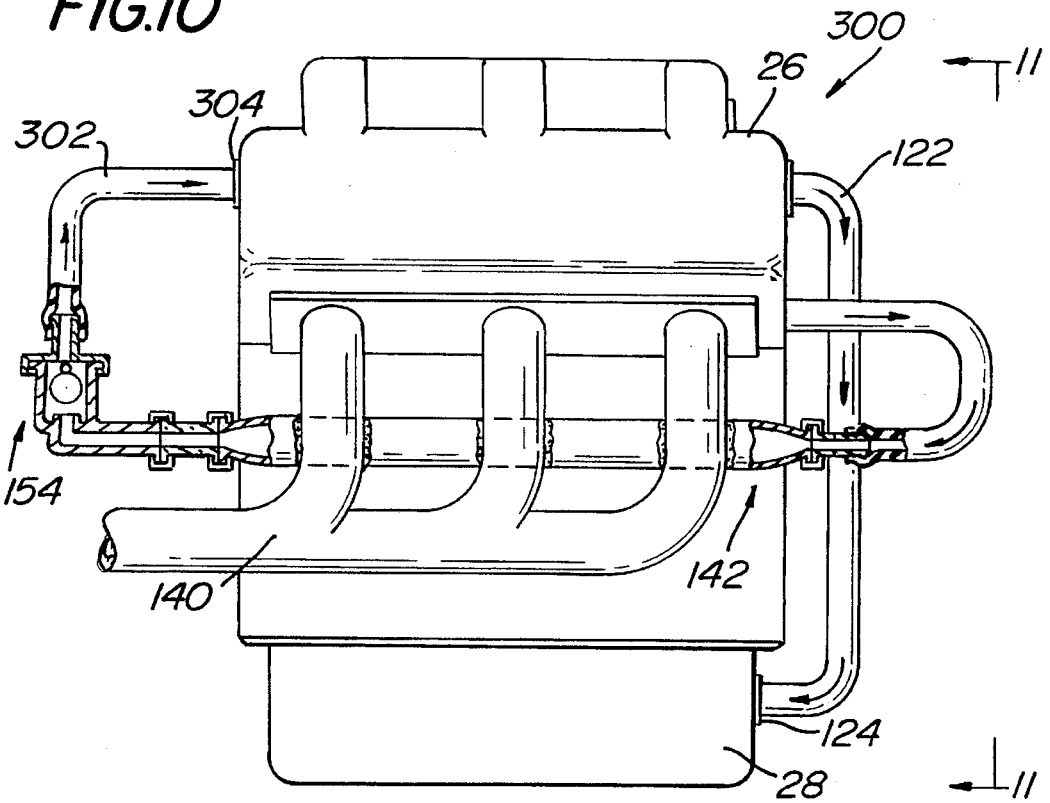
FIG. 10 is another embodiment of the novel exhaust heat assembly according to the present invention.
Figure 12:
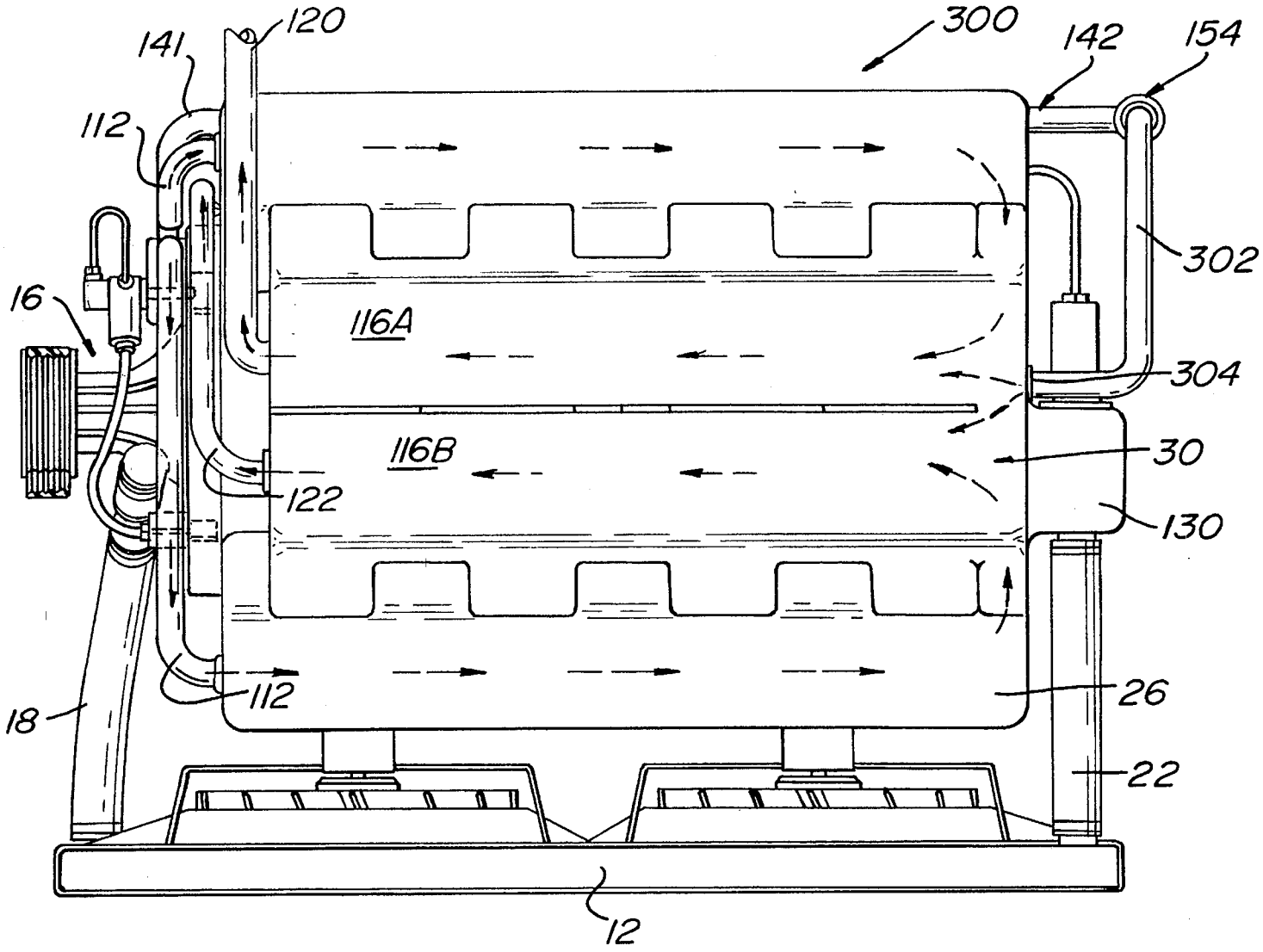
FIG. 12 is a diagrammatical plan view of the flow circuits of the temperature control fluid through the cylinder heads and the intake manifold according to one embodiment of the exhaust heat assembly of the present invention.

Another embodiment of the engine exhaust heat assembly is illustrated in FIGS. 10 through 12 and generally designated by the numeral 300. In this embodiment the heat of the exhaust gases flowing through the engine manifold 140 is transferred to the temperature control fluid flowing through the exhaust heat assembly 142 as described above. In this embodiment, instead of directing the heated temperature control fluid into and through the oil pan 28, the heated temperature control fluid is channeled through the intake manifold and/or the heater assembly for heating the passenger compartment.

The heated temperature control fluid which exits from the valving arrangement 154 is channeled by an exhaust output tube 302 directly to the intake manifold 30. The exhaust output tube 302 enters the intake manifold 30 through opening 304. The heated temperature control fluid, which enters the intake manifold 30 at opening 304, mixes with the flow of temperature control fluid flowing into the intake manifold 30 from the cylinder heads 26. This combined flow of temperature control fluid flows along channels $\mathbf{116}_A$ and $\mathbf{116}_B$. The heated temperature control fluid flows through the intake manifold and preferably exits through return tube 122 and heater tube 120. The heater tube 120 directs a portion of the temperature control fluid to the heater assembly (not shown) for heating the passenger compartment. The return tube 122 preferably channels a portion of the temperature control fluid to the engine oil pan 28 for heating the engine lubricating oil. This arrangement of the return tube 122 and heater tube 120 has been described in detail above with respect to FIGS. 1 through 6B.

When the engine oil and/or temperature control fluid reaches a predetermined temperature, the flow restrictor valves 40, 42 in the water pump stop the flow of temperature control fluid through the exhaust heat assembly 142. Accordingly, temperature control fluid no longer enters the intake manifold through opening 304. As discussed above, the valving arrangement is preferably a one-way flow valve which prevents the temperature control fluid in the exhaust output tube 302 from flowing back into the exhaust heat assembly 142.

The above embodiments disclose the channeling of fluid through a single exhaust heat assembly. However, a second exhaust heat assembly could be mounted to the exhaust manifolds on the opposite side of the block as shown in phantom in FIG. 8. In this embodiment, a second exhaust input tube (not shown) would preferably tap off of the bypass tube 110.

In yet a further embodiment of the invention (not shown), the heated temperature control fluid from the exhaust heat assembly 142 can be channeled directly from the exhaust manifold to the heater assembly for heating the passenger compartment.

Those skilled in the art would understand and appreciate that various other embodiments for channeling the heated temperature control fluid to and from the exhaust heat assembly 142 are possible and well within the scope of this invention.

Figure 13:
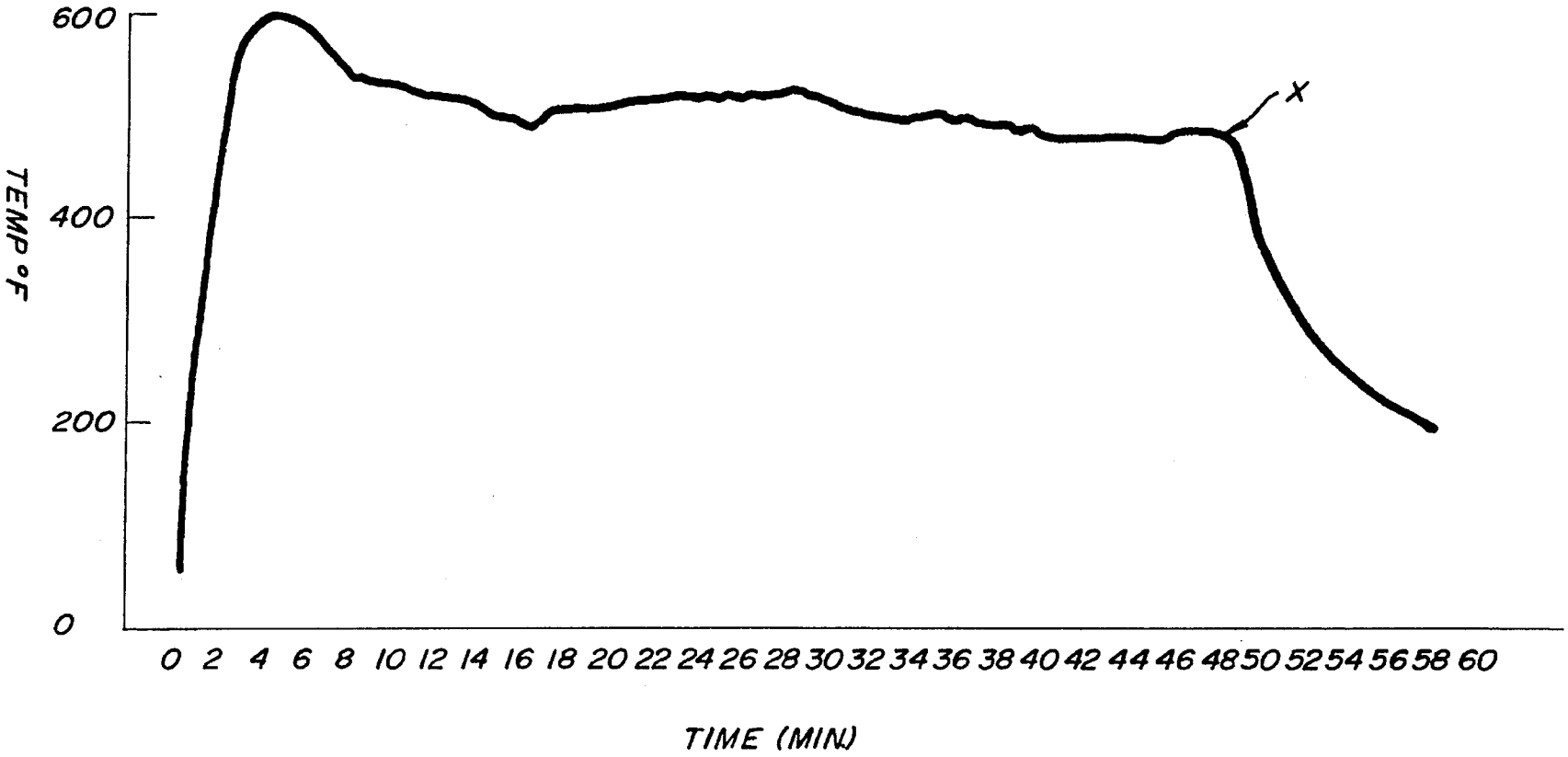
FIG. 13 is a graphical illustration of the actual temperature measured on the engine exhaust manifold of a GM 3800 V6 engine.

Referring to FIG. 13, a graphical illustration is shown of the actual temperature of the exhaust manifold as measured on a GM 3800 V6 engine. The temperatures were measured from a cold start condition. As is readily apparent, the temperature of the exhaust manifold increases from a cold start temperature to over 600 degrees Fahrenheit in approximately four minutes. This exemplifies the amount of heat that is lost through the engine exhaust. The present invention harnesses this heat and directs it back to the engine for optimally controlling the engine temperature. The point designated 'X' on the curve represents the point at which the engine ignition was turned off. The temperature in the exhaust manifold immediately begins to drop back toward the ambient temperature.

The above disclosed exhaust heat assemblies have particular utilization in the diesel engine industry. Diesel engines typically operate at a significantly lower temperature than standard automobile internal combustion engines. The lower temperatures of these engines results in increased oil sludge build-up. To diminish the development of sludge, the engine oil must frequently be changed. Truck diesel engines typically utilize 10 to 16 quarts of engine oil and, therefore, frequent engine oil changes can become quite expensive. The present invention significantly improves the condition of the engine oil by maintaining its temperature at or near an optimum temperature. As a result, the time between engine oil changes can be extended, thus reducing the cost of operating the diesel engine.

It should be noted that in the above embodiments, the engine has been described as a V-6 engine and accordingly there are two flow paths of temperature control fluid through the engine block 24 (e.g., two engine block inlets 36, 38) and also two flow paths of temperature control fluid through the cylinder heads 26. However, the invention is also applicable to an embodiment wherein there is a single flow path of temperature control fluid into the engine block 24 and/or through the cylinder heads 26. In such an embodiment, a single flow restrictor valve would be required to inhibit the flow of temperature control fluid into the block 24 and to direct the flow of temperature control fluid into the cylinder heads 24. Those skilled in the art would readily be capable of practicing the present invention on an engine of such a configuration based on the teachings of this present application. Additionally, specific engine configurations may necessitate further changes to the exemplary embodiments illustrated and discussed above. These changes and/or modifications are also within the scope and purview of this invention.

Figure 14:
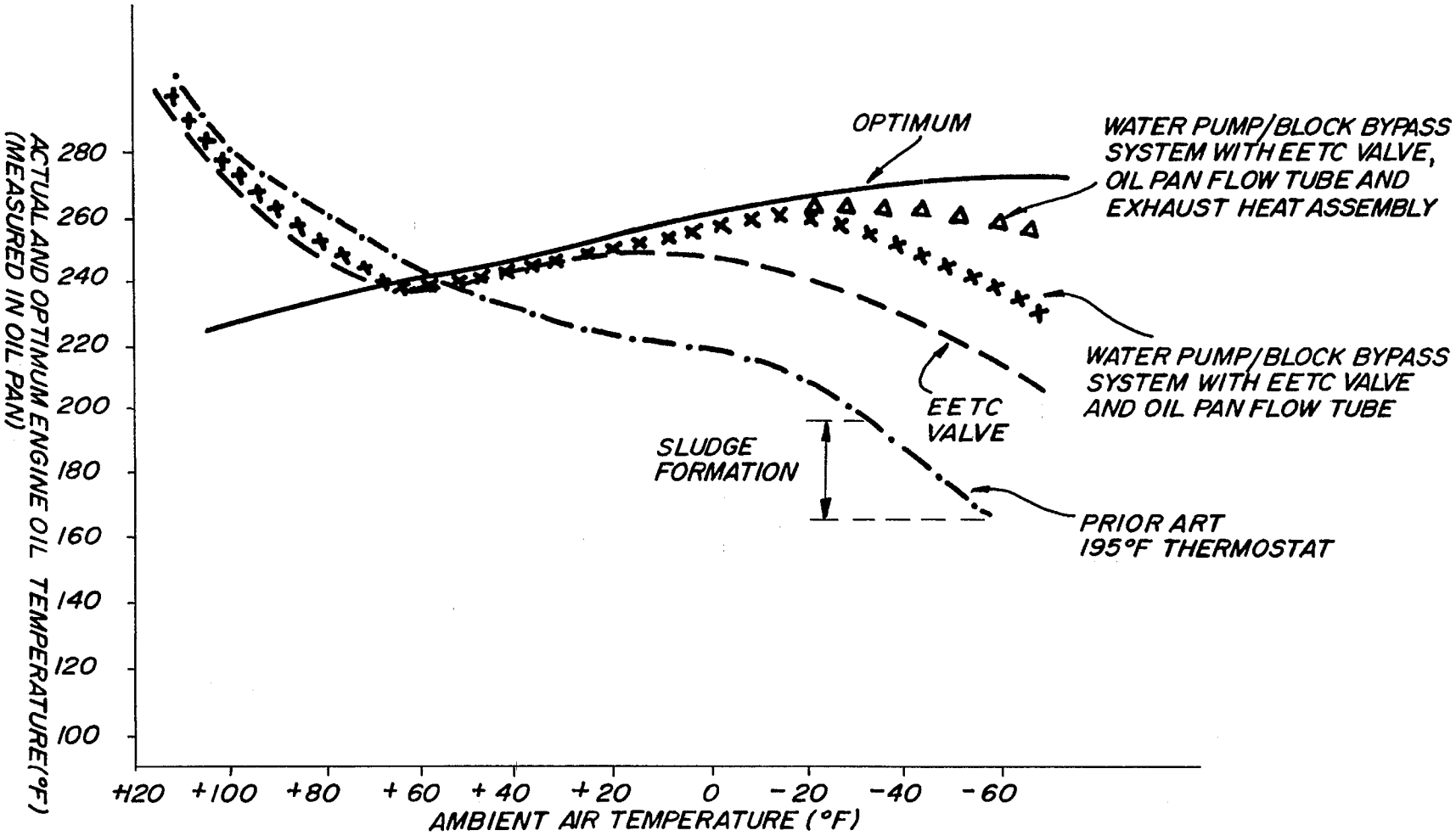
FIG. 14 is a graphical comparison of the actual engine oil temperature to the optimum oil temperature for various temperature control systems.

FIG. 14 graphically compares the actual engine oil temperature to the optimum engine oil temperature for various temperature control systems disclosed in the above-referenced related applications. As can readily be seen, a system according to one preferred embodiment of the invention, which utilizes the exhaust heat assembly in combination with the novel water pump design, maintains the actual engine oil temperature closer to the desired optimum engine oil temperature.

While the preferred embodiments utilize hydraulic fluid for controlling the state or position of the flow restrictor valves and EETC valve, other fluid media may be utilized, such as water, temperature control fluid, air, etc. Alternately, electro-mechanical devices may be utilized for controlling the valves.

Accordingly, although the invention has been described and illustrated with respect to the exemplary embodiments thereof, it should be understood by those skilled in the art that the foregoing and various other changes, omissions and additions may be made therein and thereto, without parting from the spirit and scope of the present invention.

I claim:

1. A system for heating a flow of temperature control fluid, the temperature control fluid being operative for heating and cooling an internal combustion engine, the system comprising:

a first temperature sensor for sensing the temperature of temperature control fluid;

a second temperature sensor for sensing the temperature of engine oil;

an exhaust manifold for exhausting heated gases from the engine;

an exhaust input tube adapted to direct a flow of temperature control fluid from the engine;

an exhaust output tube adapted to direct a flow of temperature control fluid to the engine;

an exhaust heat assembly connected to the exhaust input and output tubes and adapted for channeling a flow of temperature control fluid from the exhaust input tube to the exhaust output tube, the exhaust heat assembly being located adjacent to the exhaust manifold and adapted to permit heat transfer from the heated gases in the exhaust manifold to the temperature control fluid in the exhaust heat assembly;

a first flow control valve in fluid communication with the exhaust input tube; and an engine computer for controlling the flow of the temperature control fluid through the exhaust heat assembly by actuating the first flow control valve, the engine computer receiving signals from the first and second temperature sensors, the engine computer actuating the flow control valve so as to permit the flow of temperature control fluid along the input exhaust tube and into the exhaust heat assembly when the sensed temperature of the engine oil is below a predetermined value and the engine computer actuating the flow control valve so as to prevent the flow of temperature control fluid along the input exhaust tube and through the exhaust heat assembly when the sensed temperature of the temperature control fluid is above a predetermined value.

2. A system for heating a flow of temperature control fluid according to claim 1 wherein the exhaust heat assembly comprises a heating conduit with first and second ends, a first spacer attached to the first end of the heating conduit, and a second spacer attached to the second end of the heating conduit.

3. A system for heating a flow of temperature control fluid according to claim 2 wherein the heating conduit is made from a material which permits heat transfer and wherein the first and second spacers are made from a material which restricts heat transfer.

4. A system for heating a flow of temperature control fluid according to claim 3 wherein the first and second spacers are made from ceramic material.

5. A system for heating a flow of temperature control fluid according to claim 3 wherein the heating conduit is made from stainless steel.

6. A system for heating a flow of temperature control fluid according to claim 3 wherein the heating conduit extends past the exhaust manifold a predetermined distance to permit heat to dissipate from the heating conduit.

7. A system for heating a flow of temperature control fluid according to claim 1 wherein the exhaust heat assembly further comprises a second control valve mounted to the output tube for controlling the flow of temperature control fluid to the engine and preventing the flow of temperature control fluid into the exhaust heat assembly.

8. A system for heating a flow of temperature control fluid according to claim 7 wherein the control valve is a ball check valve.

9. A system for heating a flow of temperature control fluid according to claim 1, the engine including a water pump for circulating a temperature control fluid, wherein the exhaust input tube receives a flow of temperature control fluid from the water pump.

10. A system for heating a flow of temperature control fluid according to claim 1, the engine including an oil pan, wherein the exhaust output tube directs a flow of temperature control fluid to the oil pan.

11. A system for heating a flow of temperature control fluid according to claim 1, the engine including an intake manifold, wherein the exhaust output tube directs a flow of temperature control fluid to the intake manifold.

12. A system for heating a flow of temperature control fluid according to claim 1, the engine including a passenger compartment heater assembly, wherein the exhaust output tube directs a flow of temperature control fluid to the passenger compartment heater assembly.

13. A system for heating a flow of temperature control fluid, the temperature control fluid being operative for heating and cooling an internal combustion engine, the engine including an engine block, a cylinder head, a radiator, an intake manifold, an exhaust manifold for exhausting heated gases from the engine, and an oil pan, the system comprising:

a first temperature sensor for sensing the temperature of temperature control fluid;

a second temperature sensor for sensing the temperature of engine oil;

a water pump adapted for directing a temperature control fluid into the engine, the water pump including a housing, an impeller rotatably mounted within the housing, the impeller adapted for circulating the flow of temperature control fluid, a first flow channel for directing the flow of temperature control fluid into the engine block, a second flow channel for directing the flow of temperature control fluid toward the exhaust manifold, and at least one flow restrictor valve adapted for controlling the flow of temperature control fluid along the first flow channel, the flow restrictor valve being mounted to the water pump housing and being actuatable between a first position and a second position, the flow restrictor valve permitting flow of temperature control fluid along the first flow channel and restricting flow along the second flow channel when in its first position and the flow restrictor valve restricting the flow of temperature control fluid along the first flow channel and permitting flow along the second flow channel when in its second position;

an engine computer for controlling the position of the flow restrictor valve based on predetermined values, the engine computer placing the flow restrictor valve in the second position when the temperature of the engine oil is below a predetermined value, and the engine computer placing the flow restrictor valve in its first position when the temperature of the temperature control fluid is above a predetermined value;

an exhaust input tube adapted to direct a flow of temperature control fluid from the water pump when the flow restrictor valve is in its second position;

an exhaust output tube adapted to direct a flow of temperature control fluid to the engine; and an exhaust heat assembly connected to the exhaust input and output tubes and adapted for channeling a flow of temperature control fluid from the exhaust input tube to the exhaust output tube, the exhaust heat assembly being located adjacent to the exhaust manifold and adapted to permit heat transfer from the heated gases in the exhaust manifold to the temperature control fluid in the exhaust heat assembly.

14. A system for heating a flow of temperature control fluid according to claim 13 wherein the exhaust output tube is adapted to direct a flow of temperature control fluid to the intake manifold of the engine.

15. A system for heating a flow of temperature control fluid according to claim 13 wherein the exhaust output tube is adapted to direct a flow of temperature control fluid to the engine oil pan of the engine.

16. A system for heating a flow of temperature control fluid according to claim 13, the engine including a passenger compartment heater assembly and wherein the exhaust output tube is adapted to direct a flow of temperature control fluid to the heater assembly.

17. A method for heating a flow of temperature control fluid, the temperature control fluid being operative for heating and cooling an internal combustion engine, the internal combustion engine including an engine block, a cylinder head, an oil pan, an exhaust manifold, and a flow valve for controlling the flow of temperature control fluid, the method comprising the steps of:

sensing a temperature of a temperature of temperature control fluid;

sensing a temperature of an engine oil;

comparing the sensed engine off temperature to a predetermined engine oil temperature value;

comparing the sensed temperature control fluid temperature to a predetermined temperature control fluid temperature value;

actuating the flow valve so as to allow temperature control fluid to flow to an exhaust manifold heating assembly mounted on the exhaust manifold when the sensed engine oil temperature is below the predetermined engine oil temperature value; and actuating the flow valve so as to prevent the flow of temperature control fluid to the exhaust manifold heating assembly when the sensed temperature of the temperature control fluid is above the predetermined temperature control fluid temperature value.

* * * * *